US005515474A

United States Patent [19]

Deacon et al.

[11] Patent Number: 5,515,474

[45] Date of Patent: May 7, 1996

[54] AUDIO I/O INSTRUCTION INTERPRETATION FOR AUDIO CARD

[75] Inventors: John Deacon, Austin; Ron Lisle, Cedar Park; Bridget Ritthaler, Austin, all of Tex.

[73] Assignee: International Business Machines Corporation, Armonk, N.Y.

[21] Appl. No.: 479,246

[22] Filed: Jun. 7, 1995

Related U.S. Application Data

[63] Continuation of Ser. No. 975,754, Nov. 13, 1992, abandoned.

[51] Int. Cl.[6] ..... G10L 3/02; G10L 9/00

[52] U.S. Cl. ..... 395/2.1; 395/279; 395/154

[58] Field of Search ..... 395/2.1, 2.86, 395/2.7, 11, 12, 2.87, 2.79, 154; 381/42

[56] References Cited

U.S. PATENT DOCUMENTS

| | | | |
|---|---|---|---|
| 4,402,243 | 9/1983 | Deforeit | 84/604 |
| 4,422,362 | 12/1983 | Chibana | 84/1.19 |
| 4,680,796 | 7/1987 | Blackmer et al. | 381/23 |
| 4,777,857 | 10/1988 | Stewart | 84/645 |
| 4,942,551 | 7/1990 | Klappert et al. | 395/800 |
| 4,974,151 | 11/1990 | Advani et al. | 395/700 |
| 5,074,183 | 12/1991 | Chihana | 84/615 |
| 5,119,711 | 6/1992 | Bell et al. | 84/622 |
| 5,121,667 | 6/1992 | Emery et al. | 84/603 |
| 5,129,036 | 7/1992 | Dean et al. | 395/2 |
| 5,208,745 | 5/1993 | Quentin et al. | 364/188 |

FOREIGN PATENT DOCUMENTS

0484043A2 6/1992 European Pat. Off. .

OTHER PUBLICATIONS

IBM Technical Disclosure Bulletin, vol. 33, No. 10B, Mar. 1991, Provision For Alternate Midi Instrument-To-Midi Channel Assignments.

*Primary Examiner*—Allen R. MacDonald
*Assistant Examiner*—Richemond Dorvil
*Attorney, Agent, or Firm*—Jeffrey S. LaBaw

[57] ABSTRACT

A system and method for handling audio input/output data translates audio message in a first format from an audio application resident in a virtual machine to an audio voice in a second format which may have no exact match for the original audio message. The invention is used for audio applications which directly write to a particular hardware register of a particular audio card to communicate with an audio card which operates according to completely different principles. The translating program intercepts the audio message written in the first format including a first plurality of audio parameters, compares the audio parameters to those corresponding to a table of audio voices and selects the audio voice which corresponds to a match of the audio parameters in the audio message. If there is no exact match in the table, a variety of techniques are provided to calculate the closest or at least an acceptable audio voice for the original audio message. In one preferred embodiment, the audio parameters are a plurality of FM synthesis parameters and the audio voices are a set of generalized MIDI voices.

24 Claims, 20 Drawing Sheets

AUDIO I/O INSTRUCTION INTERPRETATION FOR AUDIO CARD

This is a continuation of application Ser. No. 07/975,754 filed Nov. 13, 1992, now abandoned.

BACKGROUND OF THE INVENTION

This invention relates generally to sound reproduction on a personal computer. More particularly, it relates to a method and system for decoding binary data written to specific hardware registers to a generalized interface protocol such as the Musical Instrument Digital Interface (MIDI).

In the personal computer industry, there exists a plurality of special purpose adapter cards to perform various functions. For example, a variety of game cards, device adapter cards to add computer peripherals, video cards and communication cards exist. Generally, the personal computer has a certain number of slots available to integrate these adapter cards in the computer. Approximately three years ago, Creative Labs Inc. introduced a new audio adapter card called the SoundBlaster™, which has become the industry standard for computer games. Today, virtually every software product which uses audio provides support for the SoundBlaster™.

Other audio cards must support the vast number of existing audio applications to be commercially viable. Unfortunately, most of these applications perform direct read/write operations to the SoundBlaster™ hardware registers. One solution for compatibility in the prior art is to have a similar chip set with similar registers. However, developing a clone card is very limiting and does little to advance the audio technology.

It would be preferable to enable the great number of existing audio applications to operate on any hardware platform. FM synthesis on the SoundBlaster™ does not operate according to the Musical Instrument Digital Interface (MIDI), an important industry standard for musical application, but instead, on its own esoteric protocol. Further, as the technology of audio cards advances, the existing applications must be supported or the lack of consumer acceptance will greatly hinder progress.

SUMMARY OF THE INVENTION

It is therefore an object of the invention to create a hardware independent platform for audio applications.

It is another object of the invention to interpret an arbitrary set of data to the MIDI interface.

It is another object of the invention to improve music synthesis.

It is another object of the invention to allow any audio hardware to interface with audio applications which perform direct read operations to registers.

These objects and others are accomplished by intercepting and analyzing output from an audio application to attempt to categorize it as to type of data and command. After the analysis, a table lookup is performed which matches audio data values to each of the 175 general MIDI instrument sounds. If there is no exact match, an attempt is made to determine which of the 175 general MIDI sounds is closest. Further, the data can be used to alter one or more of the MIDI control variables to vary the audio output from the general MIDI instrument.

Preferably, the invention is carried out by the use of an interface Virtual Device Driver (VDD) or a (TSR) Terminate Stay Residence module depending on the operating system. The interface module can intercept instructions while saving status information on the audio application. This allows the virtual device driver to interrogate and restore the intercepted instruction to a form compatible with an audio device driver or directly with an audio card. As generalized specifications exist for the audio device driver, it can be written for any particular audio card making the interface module completely hardware independent. The operating system creates a virtual machine in which the audio application will run. After the trapped I/O instructions are passed analyzed, they are onto the other modules of the interface module for transformation. These transformation modules can take the form of state machine. For example, a Pulse Code Modulation (PCM) state machine performs PCM record and playback emulation. A frequency modulation (FM) synthesizer state machine performs the MIDI and FM synthesis emulation.

BRIEF DESCRIPTION OF THE DRAWINGS

These and other objects and features will become more easily understood by reference with the attached drawings and following description.

DESCRIPTION OF THE PREFERRED EMBODIMENT

Figure 1:
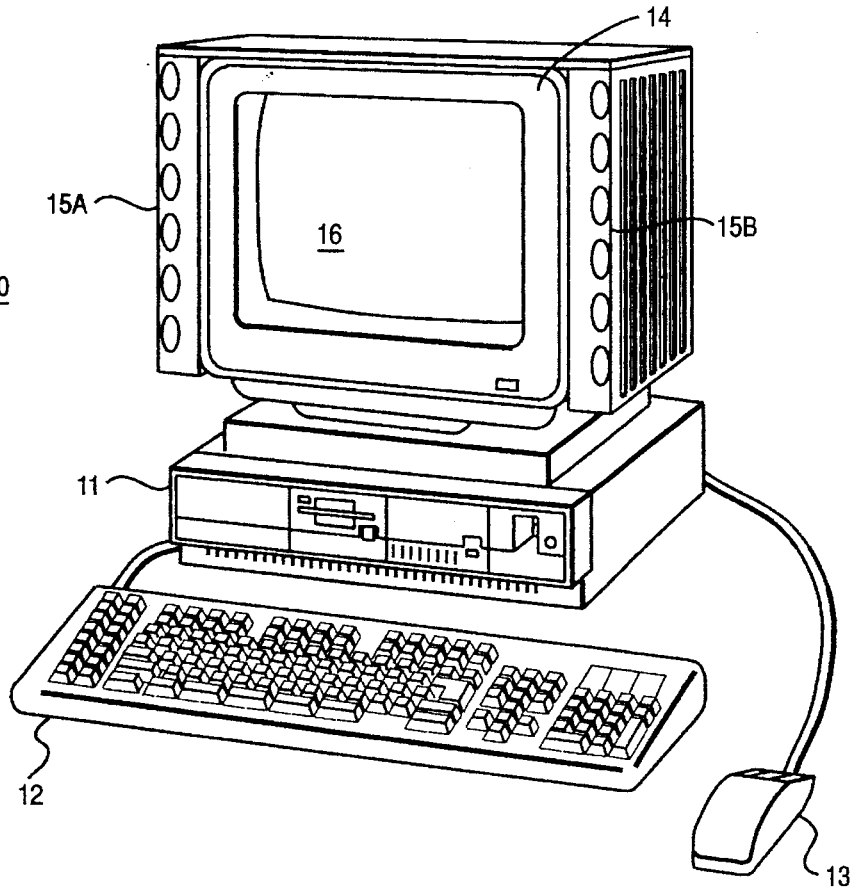
FIG. 1 is a representation of a multimedia personal computer system including the system unit, keyboard, mouse and multimedia display equipped with a speaker system.

The invention can be incorporated in a variety of computers, The processor unit could be for example, a personal computer, a mini computer or a mainframe computer, running the plurality of computer displays. The computer may be a standalone system, part of a network, such as a local area network or wide area network or a larger teleprocessing system. Most preferably, however, the invention as described below is implemented on a standalone multimedia personal computer, such as IBM's PS/2 multimedia series, although the specific choice of a computer is limited only by the resource requirements, e.g., memory and disk storage of multimedia programming. For additional information on IBM' s PS/2 series of computers, readers referred to Technical Reference Manual Personal System/2 Model 50, 60 Systems and (IBM corporation, Part No. 68X2224, Order No. S68X2224 and Technical Reference Manual, Personal System/2 (Model 80) IBM Corporation, Part No. 68X22256, Order No. S68X-2256. In FIG. 1, a personal computer 10, comprising a system unit 11, a keyboard 12, a mouse 13 and a display 14 are depicted. Also depicted are the speaker systems 15*a* and 15*b* mounted to the left and right of the monitor 14. The screen 16 of display device 14 is used to present the visual components multimedia presentation. The speaker system 15*c* and 15*b* provides good impulse and phase response with good directionality for the single listener without disturbing others nearby. Note that the very thin shape of the speaker system requires a minimum of additional desk space beyond that which would ordinarily be required by the display 14 itself. The speaker systems 15*a* and 15*b* are described in greater detail in Ser. No. 08/245,519, entitled "Multimedia Personal Speaker System", to A. D. Edgar filed Oct. 30, 1992 which is hereby incorporated by reference.

Figure 2:
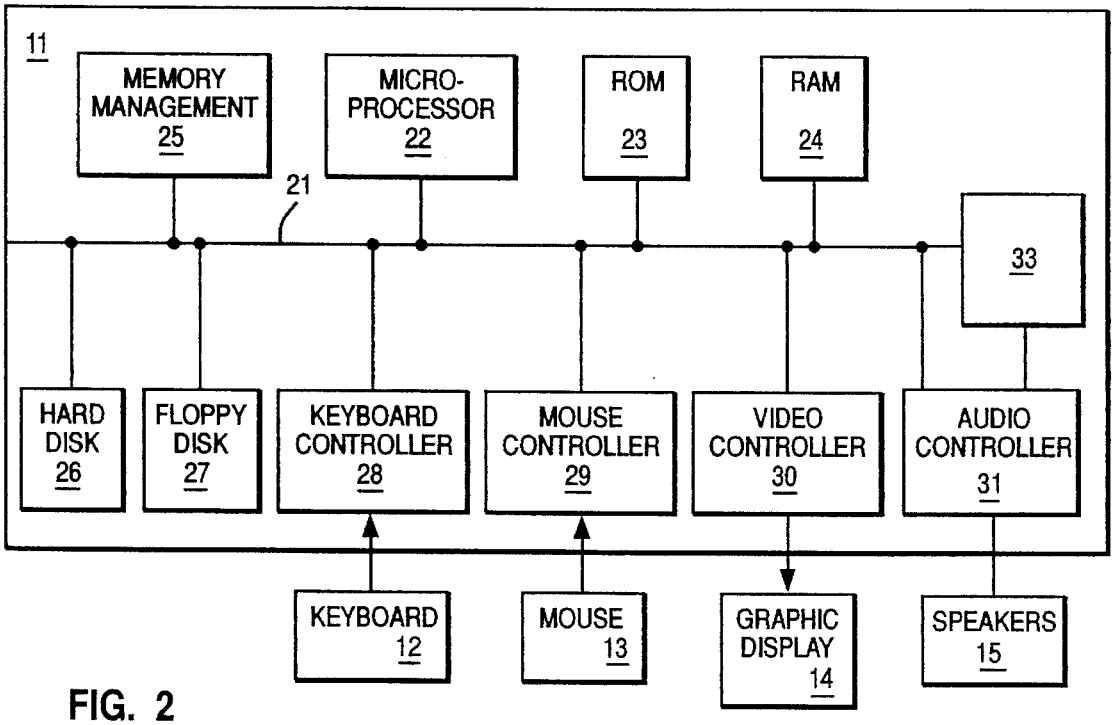
FIG. 2 is a block diagram of the multimedia computer system components of a preferred embodiment of the invention.

FIG. 2 shows a block diagram of the components of the multimedia personal computer shown in FIG. 1. The system unit 11 includes a system bus or busses 21 to which various components are coupled and by which communication between the various components is accomplished. A microprocessor 22 is connected to the system bus 21 and is supported by read only memory (ROM) 23 and random access memory (RAM) and (24) also connected to system bus 21. A microprocessor in the IBM multimedia PS/2 series of computers is one of the Intel family of microprocessors including the 8088, 80286, 80386 or 80486 microprocessors, however, other microprocessors including, but not limited to Motorola's family of microprocessors such as the 68000, 68020 or the 68030 microprocessors and various Reduced Instruction Set Computer (RISC) microprocessors manufactured by IBM, Hewlett Packard, Sun, Intel, Motorola and others may be used in the specific computer.

The ROM 23 contains among other code the Basic Input/Output System (BIOS) which controls basic hardware operations such as the interaction and the disk drives and the keyboard. The RAM 24 is the main memory into which the operating system and multimedia application programs are loaded. The memory management chip 25 is connected to the system bus 21 and controls direct memory access operations including passing data between the RAM 24 and hard disk drive 21 and floppy disk drive 27. A CD ROM 28 also coupled to the system bus 21 is used to store the large amount of data present in a multimedia program or presentation.

Also connected to this system bus 21 are various I/O controllers: The keyboard controller 28, the mouse controller 29, the video controller 30, and the audio controller 31. As might be expected, the keyboard controller 28 provides the hardware interface for the keyboard 12, the mouse controller 29 provides the hardware interface for mouse 13, the video controller 30 is the hardware interface for the display 14, and the audio controller 31 is the hardware interface for the speakers 15*a* and 15*b*. Lastly, also coupled to the system bus is digital signal processor 33 which controls the sound produced by the speaker system and is preferably incorporated into the audio controller 31.

Figure 3:
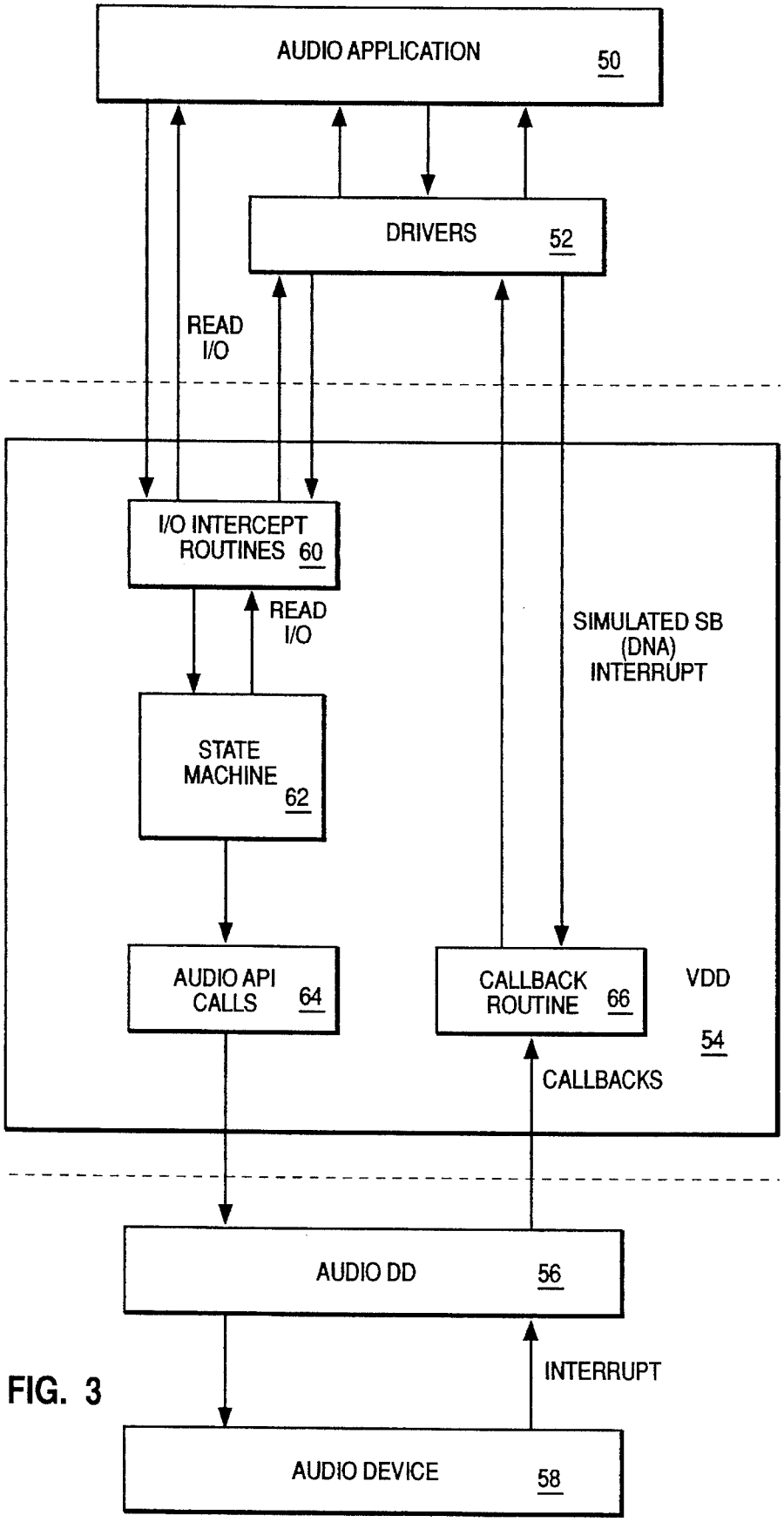
FIG. 3 is an architectural diagram of the code modules in RAM coupled to the audio device and audio device driver according to the present invention.

FIG. 3 depicts an architectural block diagram of the code modules in memory coupled to an audio device according to one preferred embodiment of the present invention. The application 50 is maintained in a virtual machine by the operating system. The I/O instructions from an audio application 50 or its audio device drivers 52 are trapped by the virtual device driver (VDD) 54. In practice, almost all existing audio applications communicate without the use of the device drivers, intending to write directly to the hardware registers. The VDD 54 communicates with the audio device driver (ADD) 56. Similarly, it translates messages from the ADD 56 into a form usable to the application 50. The ADD 56 is coupled directly to the audio device 58 and shields the other code modules from needing any knowledge of the hardware in the audio device. In an alternative embodiment, the VDD 54 reads and writes directly to the audio card. However, in this embodiment the VDD is not hardware independent. The audio card is described in detail in connection with FIG. 10. Within the VDD there are code modules for the I/O interrupt routines 60, a state machine 62, audio API calls 64 and a callback routine 66.

When the VDD 54 is installed or a virtual machine session is created, the VDD tells the operating system that it is interested in knowing when accesses to a list of I/O addresses occur. After this, every time one of the I/O ports is accessed, control is transferred to the VDD I/O intercept routine 60. These routines set up calls to the device specific portion. This routine 60 will look at the port that was accessed, whether the I/O instruction was a request for a read or write access, and what the data was that was being written (if a write access) to the port. The intercept routine 60 takes all this information and does any of the necessary processing to translate this information into the audio API calls/information 64. The audio API calls 64 are a set of routines that make calls to the physical audio device driver 56 that controls the audio device to which the translated audio information is sent. One preferred API is covered in the Audio Device Drivers for IBM Personal Computers specification which is available from the IBM Corporation and hereby incorporated by reference. The audio device may send interrupts when certain events have occurred, such as the completion of processing the data. The ADD 56 will then inform the VDD 54 of the event by calling the callback routine 66. The callback routine 66 is used mainly for identifying when a buffer of PCM data which the application requested to be DMAed to the audio device has completed playing. When the VDD 54 receives the callback, it will then send a "virtual" IRQ to the application to let the application 50 know that the "DMA" has completed processing.

When the VDD is installed, it tells the operating system what DMA channels it is interested in, similar to hooking the I/O ports. For SoundBlaster, DMA channel 1 is used. From now on, the VDD will get control whenever MASK or MASK_OFF event on the DMA is done. If it is the VDD doing the MASKing, then it is important to determine the data buffer being DMAed so it can be sent to the audio device driver. The VDD can be identified by checking the id of the process that is doing the access to the DMA (which is supplied by the operating system) with the id of the process that has been doing accesses to the audio I/O ports.

The physical address of the data buffer to be DMAed and the size of the buffer can be read from the DMA registers. However, in OS/2 this presents a problem. OS/2 has a virtual device driver for the DMA. Because of this, every time the DMA is programmed by a process, the DMA virtual device driver intercepts the information. The actual programming of the DMA is done only after control has been passed to our virtual device driver. So at the time that the DMA Handler gets control, the data address and size is not available in the DMA registers. To get around this, a timer is set in the DMA Handler to go off as soon as possible (1 msec) at which time a DMA Timer routine is given control. By the time the timer expires, the DMA Handler has returned to the OS/2 virtual DMA device driver and it has programmed the DMA with the data address and size. The DMA Timer routine can then go and read the information it needs from the DMA registers.

The data buffer is then sent to the audio device driver (56). When the audio device driver is finished processing the data, it will give a callback (66) to the virtual device driver. At this time, the virtual device driver will generate an interrupt on the same interrupt level that the DMA would have. The application sees this interrupt and continues with the next buffer of data to be processed.

For DOS and Windows, the size and address of the data is available at the time the DMA Handler is given control. Therefore, none of the extra processing in FIG. 3 is required.

An interesting feature of the Intel 80386 and above microprocessors is its virtual 8086 or V86 mode of operation. In this mode, a virtual 8086 machine is created. Audio applications may be run on this V86 virtual machine under the control of operating system code. Privileged instructions intended for a hardware register can be trapped by the operating system which also stores status information on the application to allow the operating system to interrogate and restore the instruction. A virtual device driver may be used to intercept codes from the audio application in the virtual 86 machine. Whenever the audio application attempts a read or write to one of the known audio register I/O locations, the virtual device driver intercepts the instruction and emulates it using the functions available with the substituted audio hardware.

The 80386 processor can run in real (normal under DOS), protected, or virtual-8086 (or V86) modes. The V86 mode is designed to run real-mode programs in a protect-mode environment. For example, as in running DOS programs in the OS2 "DOS-box" When in V86 mode, the processor compares the port address of each IN/OUT instruction against a bitmap which defines which ports the current program is privileged to access. If the corresponding bitmap bit is a "1", the access is not allowed and a protect fault will occur.

The interface module may also be implemented as a terminate stay residence (TSR) module that enters protect mode and then exits back to V86 mode with the bitmap set for the desired I/O ports. As part of entering protect mode, a Global Descriptor Table (GDT), a Local Descriptor Table(LDT), an Interrupt Descriptor Table(IDT), and a TASK State Segment (TSS) must all be initialized. After the TSR returns to DOS, all subsequent programs will run in V86 mode. Protect faults due to accesses of selected I/O ports will be handled by the TSR. The I/O instructions can then be conveniently mapped to other I/O ports and/or program functions as required. All software interrupts will also cause a protect fault. The TSR must recognize the software interrupts and pass them on to the correct software interrupt handler via the interrupt vector table.

In OS/2 2.0 and Windows. 3.1, a virtual device driver can be used to trap I/O interrupts to a physical device driver, e.g., an audio device driver, or directly to a hardware registers. Many existing applications were written to use the entire resources of the computer system and thus can not operate in a multiapplication environment without assistance from the operating system. The virtual device driver allows applications to share a hardware resource such as an audio card. Typically, the VDD is used simply to trap the I/O data and send it to the appropriate port with little transformation of the data into another form. This is true as the application is writing to the same hardware or device driver as it was in the single application environment. In the present invention, the VDD is different as it causes the application to interact with completely different hardware than that for which it was originally written.

The virtual device driver is comprised of: a basic hyperviser, and state machines that provide FM synthesizer and other audio functions. The basic hyperviser performs the trapping of I/O instructions and passes the trapped instructions to the state machines. In addition, the VDD emulates the operation of the Direct Memory Access DMA controller. Variable sample rates between 4 thousand and twenty-three thousand samples per second are supported by SoundBlaster™ audio hardware. As the substitute audio hardware may not be able to support the arbitrary sample rate selected by the application, the physical device driver will map the requested sample rate to the nearest available rate.

The FM synthesizer state machine performs a MIDI and FM synthesis emulation. The FM synthesizer registers data written to the FM registers is analyzed and converted to MIDI data conforming to the general MIDI recommended practice. General MIDI is NOT a standard—just a recommended practice. The frequency data in Table 1 is used to determine the MIDI note to use. The data in Table 1 is used to determine which general MIDI instrument sound is to be generated. This may result in the generation of a MIDI program change if there is a change an any parameter in Table 1. Also, a slight difference in the total level of the carrier is used to determine the MIDI Note-on value.

The following parameters are used with the SoundBlaster™ to determine the note to be played:

| Parameter | Size_in_bits |
|---|---|
| F-Number | 10 |
| Block | 4 |
| KeyON | 1 (1 = ON, 0 = OFF) |

Figure 4A:
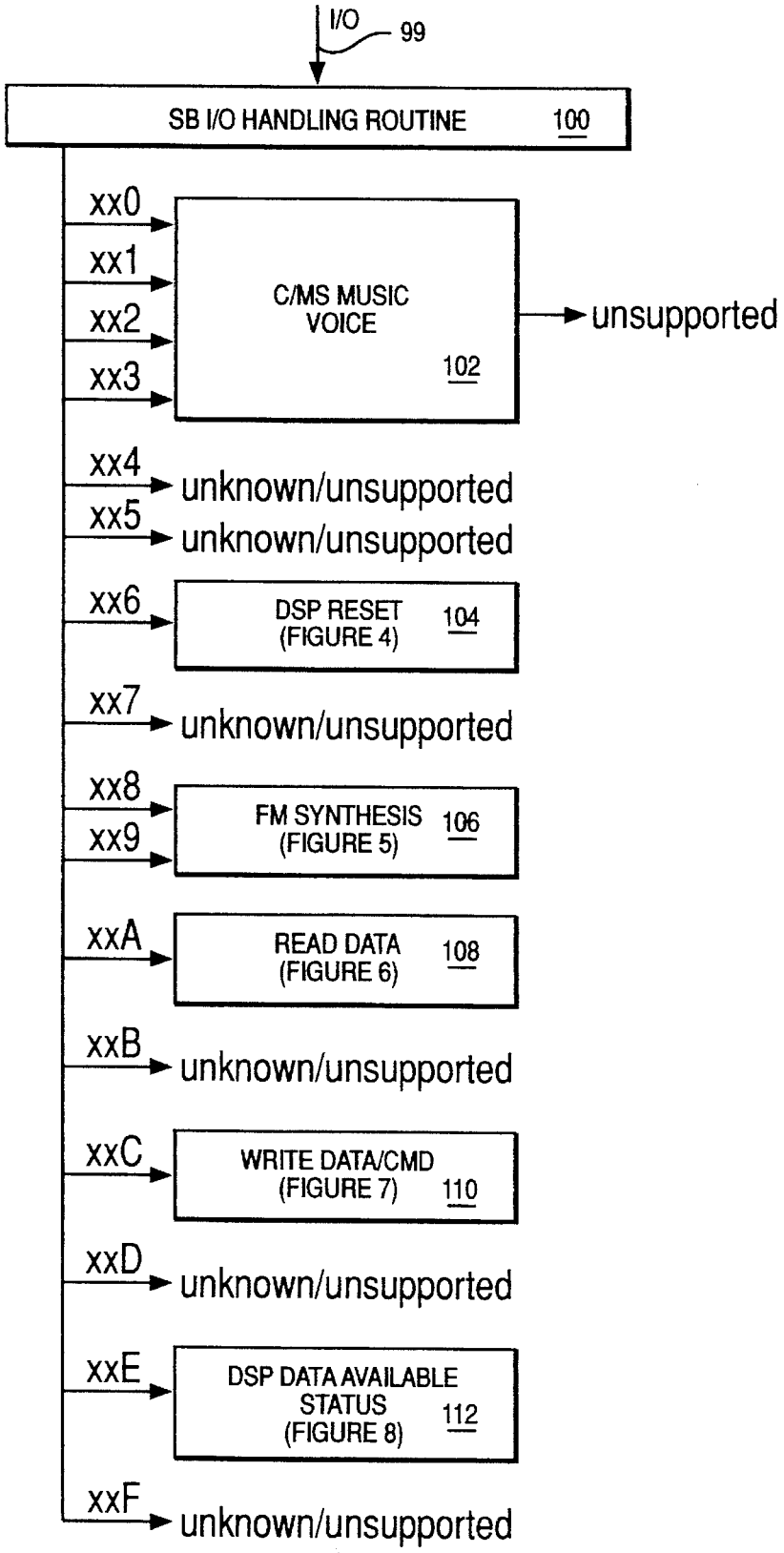
FIGS. 4A and 4B are diagrams of the generalized flows for I/O request handlers which intercept I/O from audio applications to the various ports of two different audio cards.

FIG. 4*a* depicts typical I/O requests which are made by the audio application. An I/O request is sent along input line 99 and intercepted by a code module 100 which determines to which port the application was writing. The ports in the diagram are listed as xxI through xxF which represent a sequence of 16 adjacent ports which the personal computer recognizes as ports allocated to the audio card. For example, the ports may be 220 through 22F or 380 through 38F. Depending on the nature of the I/O request, the audio application will attempt to send the I/O request to a specific I/O port. In the SoundBlaster™ audio card, I/O ports xx0, xx1, xx2 and xx3 are used for C/MS-404 quality synthesizer another type of synthesis other than FM synth) which is not widely popular type of music processing. I/O port xx6 is used for resetting the DSP. I/O ports xx8 and xx9 are used for FM music control processing. I/O port xxA is used for DSP voice I//O and MIDI read data. I/O port xxC is used for DSP/command processing. I/O port xxE is used for the DSP data available status.

The I/O Handling Routine 100 traps the instructions which are intended for a specific hardware port and sends them to the appropriate procedure. I/O commands or data to the xx0 through xx3 ports are sent to the C/MS music voice routine 102. The CM/S music voice routine is a specialized synthesis routine which very few applications use. Thus, the VDD need not support this routine, although it could be performed similarly to the FM synthesis routine in FIGS. 6A–6I. I/O commands to the xx6 port are sent to the DSP reset procedure 104 which is depicted in greater detail in FIG. 5. I/O commands for FM synthesis are normally sent to ports xx8 and xx9. After interception, they are sent to the FM synthesis procedure 106 shown in greater detail in FIGS. 6A–6I. I/O to the xxA port is sent to the Read Data Procedure 108 depicted in FIG. 7. I/O to the xxC port is sent to the write Data/CMD procedure 110 depicted in FIGS. 8A–8I. The DSP Data Available/Status procedure described in conjunction with FIG. 9 receives the I/O data intended for the xxE port. I/O instructions to the other ports in the figure are treated as NOPs.

Figure 4B:
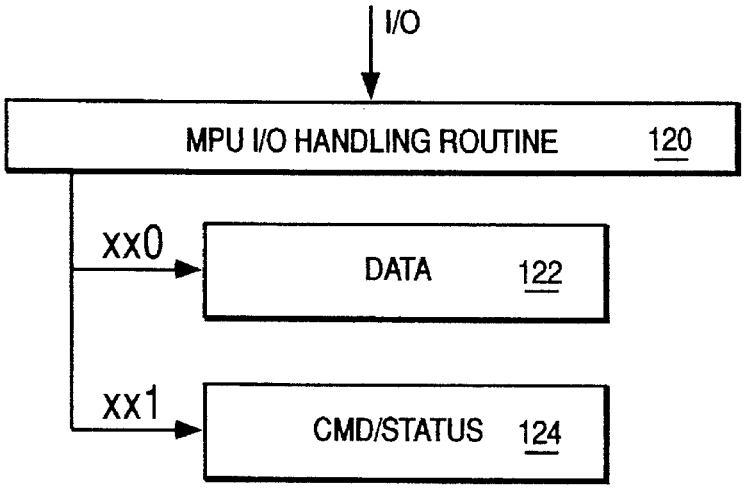

The I/O handling routine can be much simpler depending on the audio card to which the application is intended to write. For example, in FIG. 4B, the I/O handling routine for an MPU™ card manufactured by the Roland Corporation is illustrated, The I/O instructions from the application are intercepted by the MPU I/O handling routine block 120 which determines whether the I/O instruction is data or command/status information bound for port xx0 or xx1. If it is data information, normally received at the first port, it is sent to the data block 122. If it is command or status information, normally sent to the xx1 port, the I/O instruction is handled by the command / status block 124. In one preferred embodiment of the invention, a plurality of I/O handlers are provided to handle audio input/output data written for a plurality of different hardware platforms. Thus, a first application written for the SoundBlaster™ card could operate concurrently with a second application written for an MPU card, where the actual audio I/O operations are performed by a third audio card for which neither the first and second application were written.

FIGS. 5–9 accompany a more detailed description of the processes in the modules in FIG. 4A. In these flow diagrams, specific values for various parameters are given which are based on the expectations of an audio appreciation written to directly read or write to the SoundBlaster™ card. One skilled in the art would recognize that similar procedures could be written for the I/O handler depicted in FIG. 4B, and other I/O handlers for other hardware, but that the specific parameters may differ from those below. Although the processes are not depicted as traditional state machines, they respond with a particular function to the I/O instruction and state of the audio applications.

Figure 5:
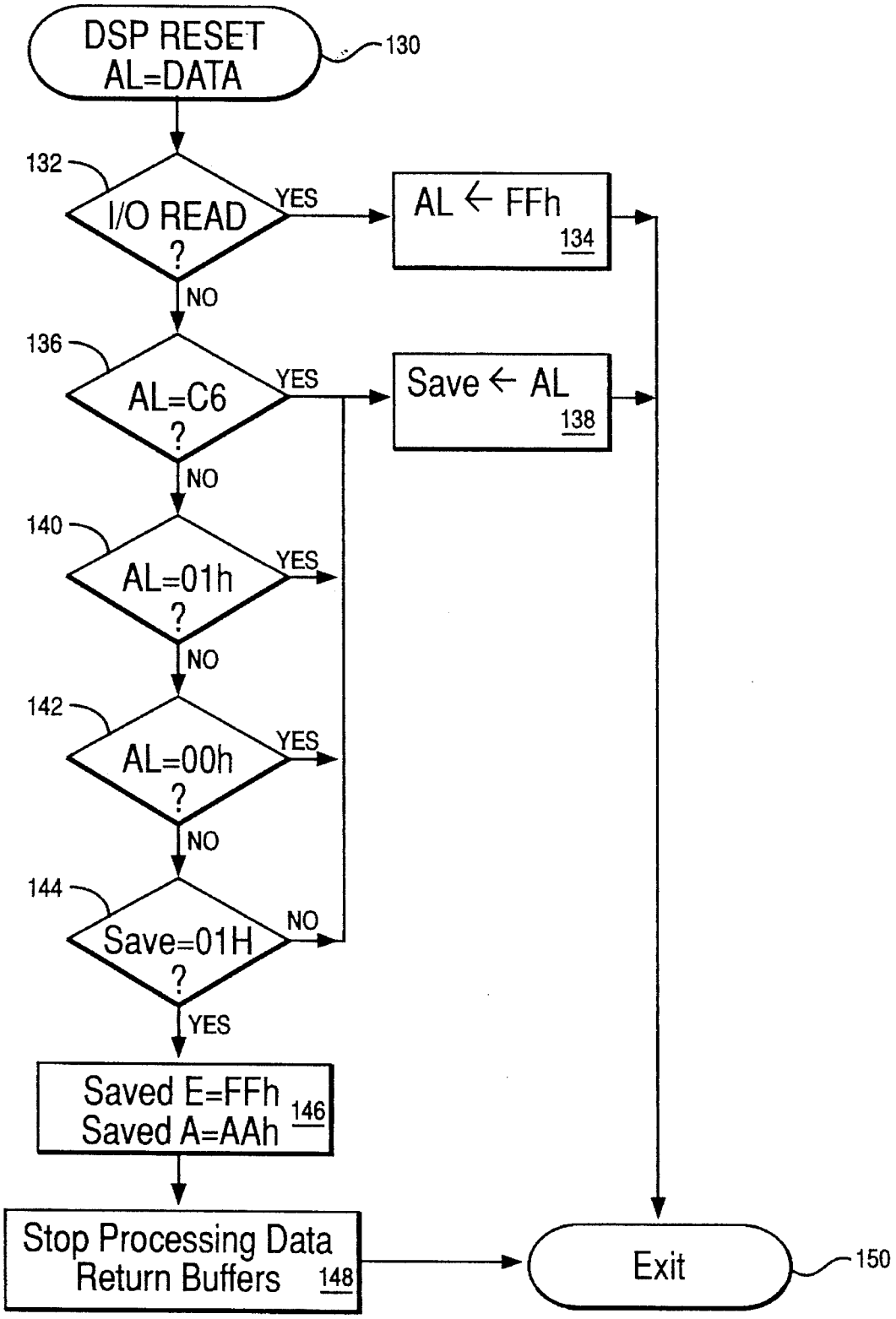
FIG. 5 is a flow diagram of the digital signal processor (DSP reset function.

FIG. 5 depicts the process to reset a digital signal processor. When the xx6 port is written, a DSP reset command is being performed on the card. The process begins in step 130 with a DSP reset command. Next, a test is performed, step 132, to determine whether the input is an I/O read. If it is an I/O read, the output variable is set to FFh in step 134 and returned to the audio application. The xx6 port is a write only port. If a write only port is read the hardware which is emulated by the embodiment of the invention returns FFh. In steps 136, 140 and 142 tests are performed to determine whether the I/0 input from the application equals certain values. If so, the I/0 value is saved in step 138 for future use by the VDD. If not, a test is performed to determine whether an input value of O1h had previously been saved, step 144. If so, in step 146, the savedE variable is set to FFh indicate that data is available from the DSP and the savedA variable is set to AAh. Throughout the diagrams whenever savedE is set to FFh, it means that there is data available in the xxA port to read. The VDD contains a table which stores the last input to and last output from a particular "port". For example, a savedA input value is the value to be sent back to application on next read access of xxA port. A savedA output value is the last value written to xxA port by application. In step 148, all processing on the audio card is stopped as the application has asked that the DSP be reset and the buffers are returned to the operating system. When port xxE and port xxA are read the next time, the correct values will be waiting to be sent to the application. The process ends in step 150.

FIGS. 6A through 6I depict the process for emulating FM synthesis with the general MIDI instrument interface. The process begins in step 160 when port xx8 or xx9 are written to by the audio application. Step 160 determines whether a command was written to port xx8 or not. If it was written to port xxS, a test is performed to determine whether the instruction calls for an I/O read operation, step 162. If not, step 164 causes saved8 output to be equal to AL, and the process ends, step 165. If the I/O instruction does call for an I/O read, a test is performed to determine whether timers are used by the audio application in step 166. If the application does use timers, in step 168, AL is set to saved8 input and the process exits in step 165. If the application does not use any timers, in step 170, a counter for the consecutive times port xx8 is accessed is incremented in count. Next, in step 172, the counter is tested to determine whether to see if five or more reads to the xx8 port have been done in a row. If so, the VDD interface will evaluate the code that the application is processing and if it determines that the application is wasting time, then it will NOP out the instructions in the application code which is performing excessive reads to the port. This speeds up processing considerably and improves performance, step 174. The process continues through steps 168 and 165.

If this was an I/O access to the xx9 port, first, a test is performed in step 176 to determine whether the application has made an I/O read request. If so, the process exits, step 165. If the application has made an I/O write request, the counter for port xx8 accesses is reset in step 178. Next, the I/O instruction is saved in the FM table, step 180. For some values written to the I/O port, no action is taken. If the I/O instruction is 02h, an 80 MSEC timer is set in step 182. If the I/O instruction is 03h, a 320 MSEC timer is set in step 183. If the I/O instruction is 04h, the timer control procedure is called in step 184. If the I/O instruction equals BDh, the depth/rhythm routine is called in step 188. If the I/O instruction is BOh to B8h the key-on/block routine is called in step 189. The process ends in step 190.

Figure 6H:
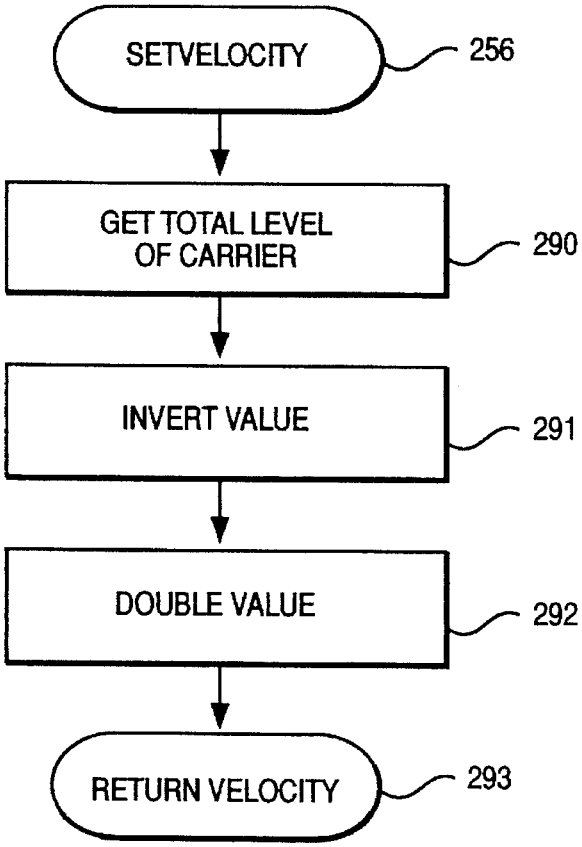
FIG. 6A–6I are flow diagrams of the FM synthesis procedure.
Figure 6A:
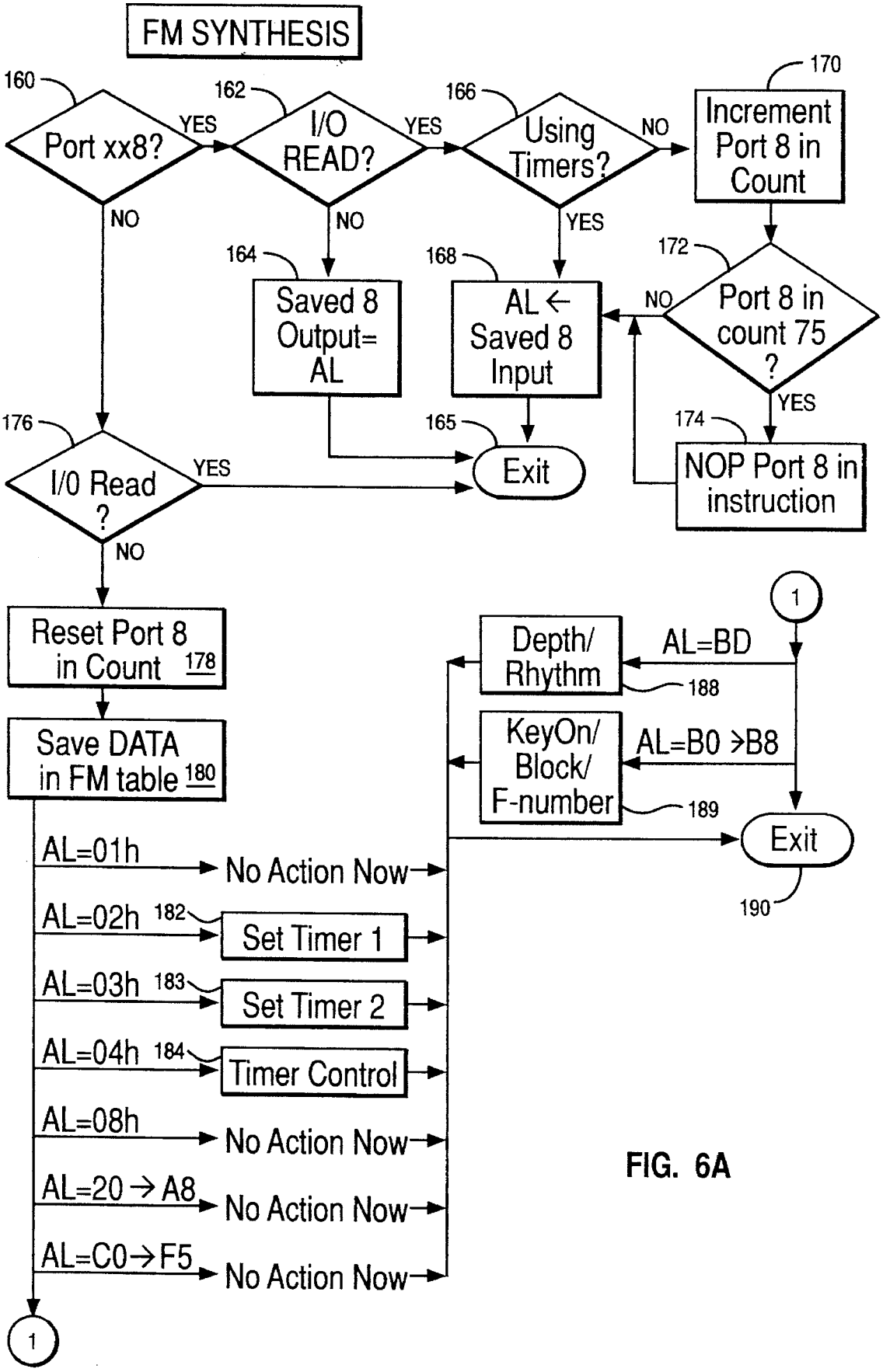
Figure 6B:
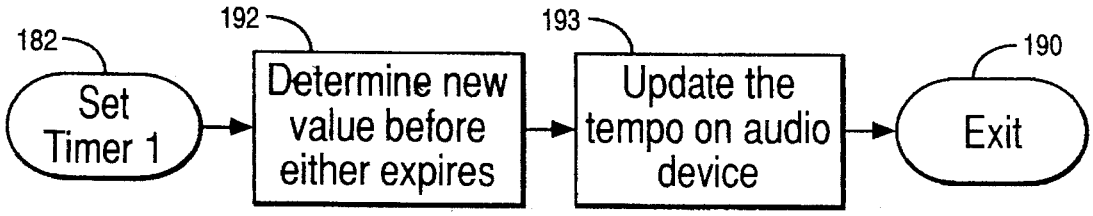

FIG. 6B describes the set timer 1 routine in greater detail. Processing begins in step 182 where an I/O instruction of 02h, is detected. Next, in step 192, the new value of a 80 millisecond timer is determined before either time expires. In step 192, the least common denominator of Timer 1 and Timer 2 is determined. The least common denominator determines the rate at which VDD timer counters are set up for both Timer 1 and Timer 2, for the number of times the VDD timer needs to go off before Timer 1/Timer2 has really expired. In step 193, the tempo is updated on the audio card. The process ends in step 190.

Figure 6C:
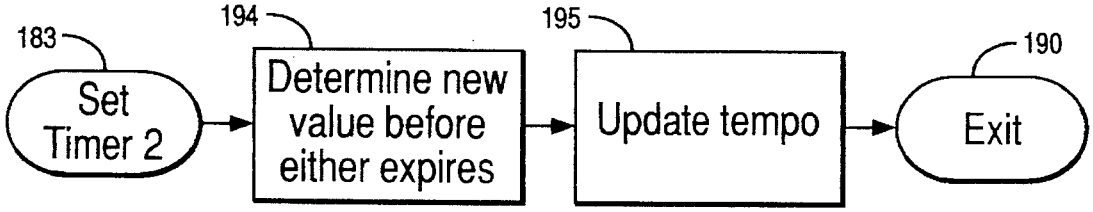

FIG. 6C describes the set timer 2 procedure which is basically similar to set timer 1 procedure except that the timer in this case is a 320 millisecond timer rather than a 80 millisecond timer in the set timer 1 procedure. The process begins in step 183 when the I/O value of 08 is received. Next, the new value of the timer is determined before either expires in step 194 as described above in reference to step 192. Next, in step 195, the tempo on the audio device is updated. The process ends in step 190.

Figure 6D:
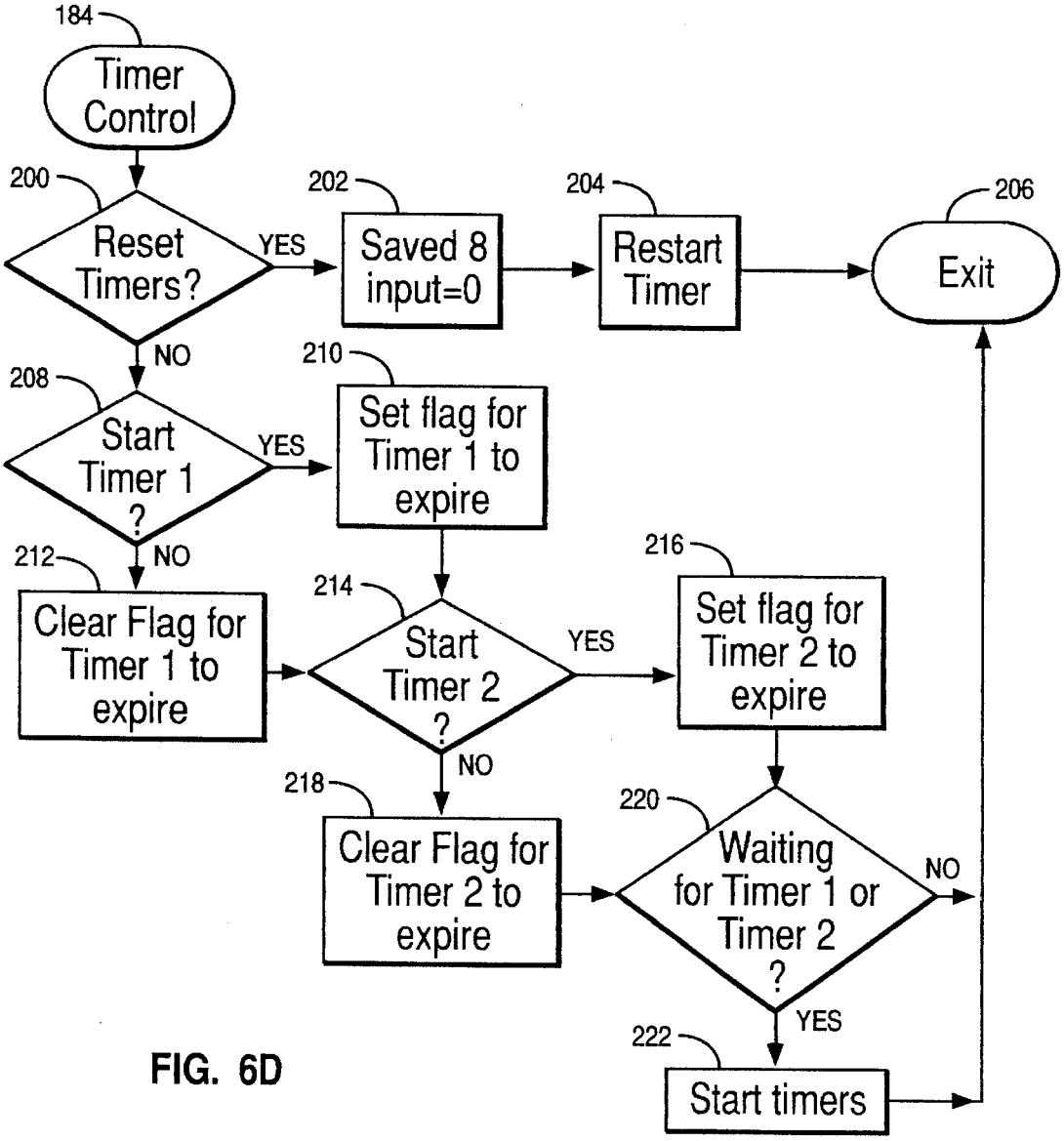

The timer control procedure is described in greater detail in FIG. 6D. The process begins in step 184 when an I/O value of 04h is received. In step 200, a test is performed to determine whether the timers should be reset. If so, in step 202, the saved8 input variable is set to 0. Next, in step 204, the timer is restarted and the process ends in step 206. If timers are not to be reset, in step 208, a test is performed to determine whether timer 1 should be started. If so, a flag is set in step 210 which indicates that the application is waiting for timer 1 to expire. If not, in step 212, the flag is cleared which indicates that the application is not waiting for timer 1 to expire. Next, in step 214, a test is performed to determine whether timer 2 should be started. If so, a flag is set in step 216 which indicates that the application is waiting for timer 2 to expire. If not, the flag is cleared which indicates that the application is not waiting for timer 2 to expire. Next in step 220, a search is performed for the flags indicating that the application is not waiting for timer 1 or timer 2. If the application is waiting for either or both of the timers, the timers, are started in step 222 and the process exits, step 206. Restarting the timers basically assures that the timer has expired already and the VDD wants to know when the next timer expires. Starting the timer basically means to start reporting expiration of that timer.

Figure 6E:
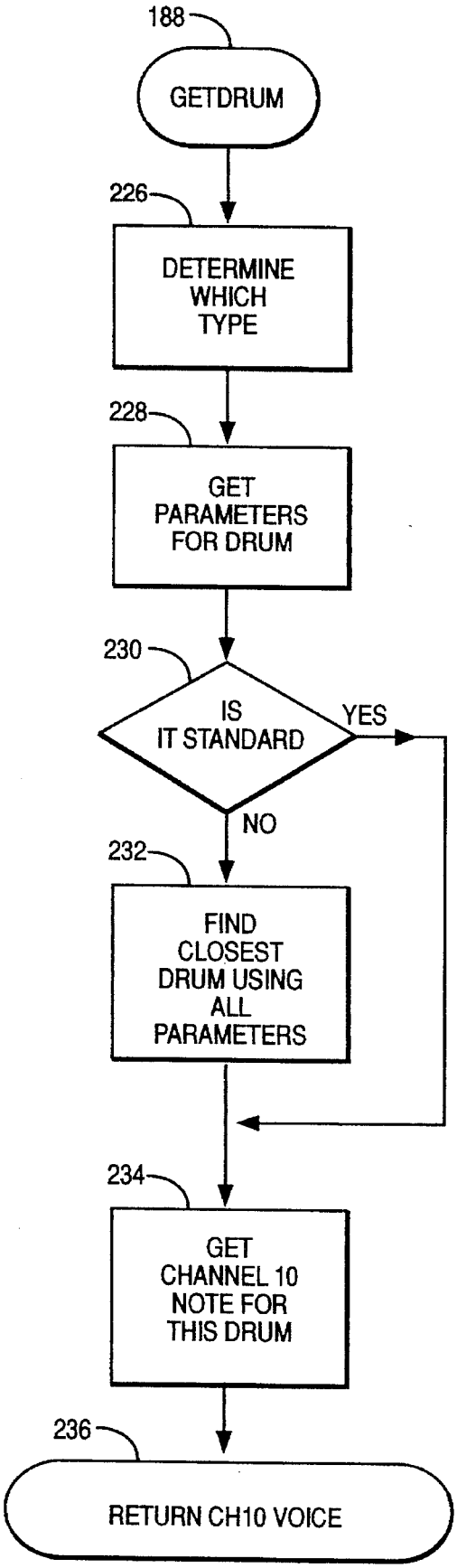

The depth and rhythm procedure is described in greater detail in FIG. 6E. First, in step 188, the "Drum" procedure is retrieved in response to an I/O instruction equal to BDh. In step 226, the type of rhythm is determined. In step 228, the parameters for the rhythm are retrieved by using the bits stored in the xx9 port output. Next, in step 230, a test is performed to determine whether it is a standard rhythm. If it is not a standard rhythm, step 232, finds the closest rhythm using all the parameters. If it is a standard rhythm, step 232 is skipped. Next, in step 234, the channel 10 note for this rhythm is retrieved, the MIDI channel for rhythm effects. Finally, in step 236, the voice on channel 10 is returned to the application.

The Key-on/block/Fnumber procedure is described in FIGS. 6F through 6I. The process begins in step 189 when an I/O instruction in the range of BOh through B8h is received. A test is performed in step 240 to determine whether the audio card is initialized for MIDI yet. If not, the device is initialized to play MIDI, step 242. In step 244, a test is performed to determine whether a key is turned on. If so, another test is performed in step 246 to determine whether any of the values for this channel have changed since the last time. If they have changed, in step 248, the set voice procedure is called. Next, in step 250, a test is performed to determine whether a new voice is returned. If so, the new programmed parameters for the new voice are output to the audio card in step 252. If it is not a new voice, step 252 is skipped. In step 254, a test is performed to determine whether the velocity of the voice has changed. If so, the set velocity procedure is called, step 256. Next, the get key procedure is called in step 258. The MIDI message is sent to the audio device in step 260 and the process ends in step 262. If in step 244, the key was not turned on, a test is performed in step 264 to determine whether the note is on at a second time. If so, the velocity is set to 0 in step 266 and the MIDI voice is sent to the audio device. If the note is not on at the second test, the process exits at step 262.

Figure 6F:
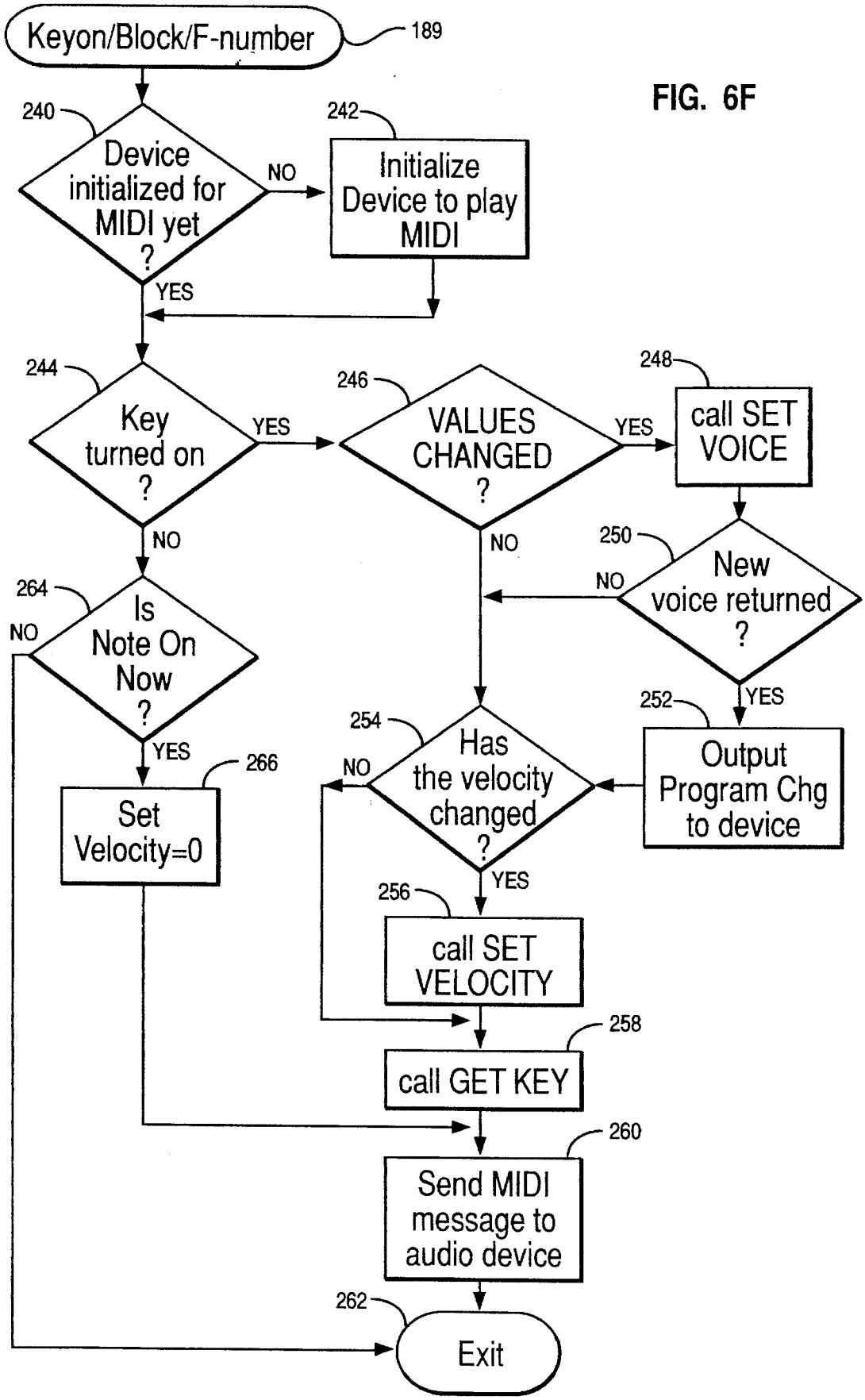
Figure 6G:
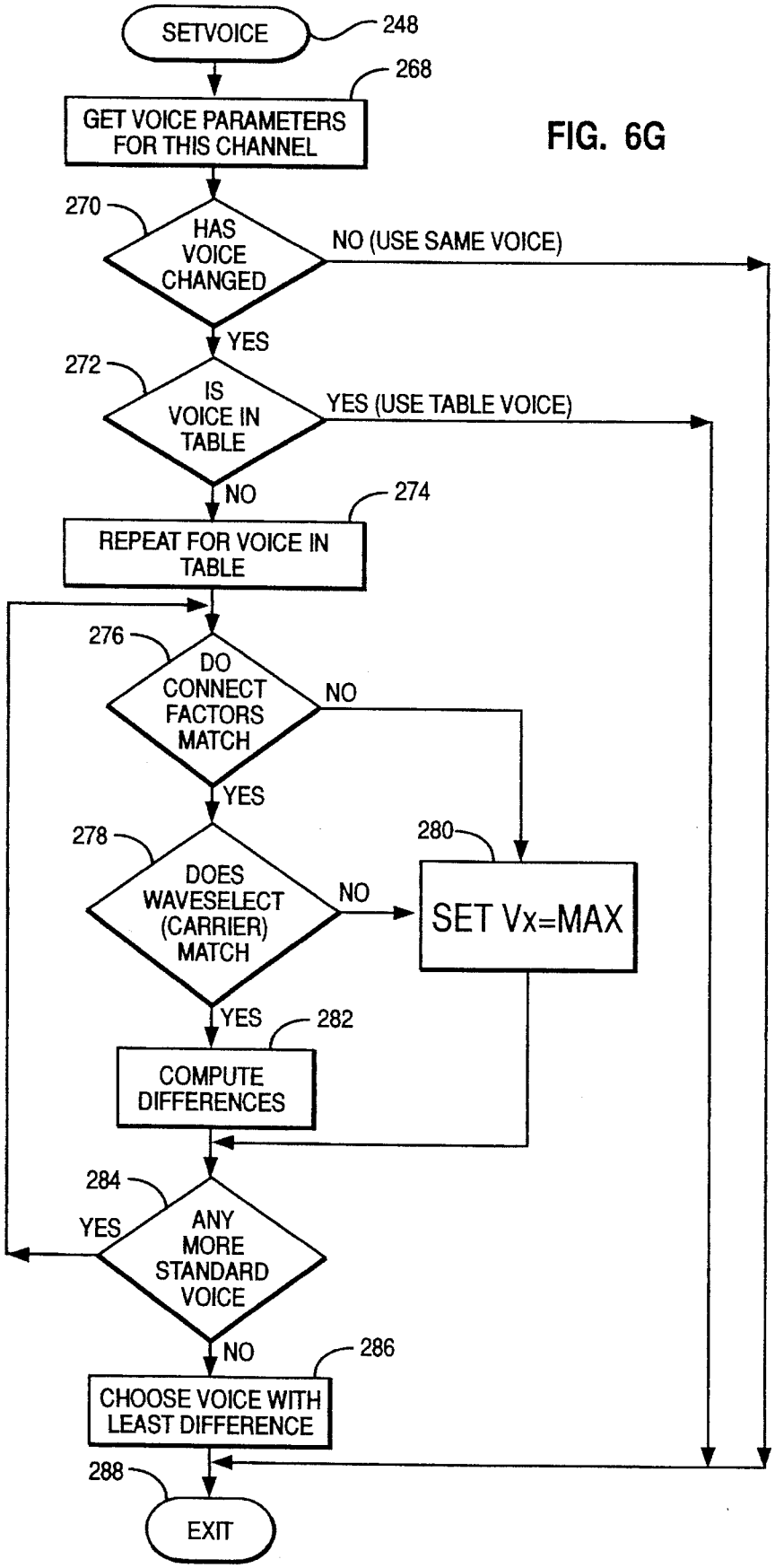

FIG. 6G describes the set voice procedure in step 248 in greater detail. First, the voice parameters for this channel are received in step 268. A test is performed to determine whether the voice has changed, step 270. If not, the same voice is used and the program exits. If the voice has changed, a step is performed in step 272 to determine whether the voice is in the table. If the voice is in the table, the table voice is used. If not, in the step 274, a comparison between the unknown voice and each voice in the table is started. In step 276, a test is performed to determine whether the connect factors match. If they do, a test is performed to determine whether the wave select carrier matches. If either of these steps fail, in step 280, VX is set to the maximum. Thus, this voice will be too different to be deemed the closest voice in the step 286 below. In step 282, the differences between various parameters for the carrier and modulator are for the various MIDI voices are determined. A test is performed in step 284 to determine whether there are any more standard voices to test. If not, in step 286, the voice with the least difference from the voice parameters is chosen. The process ends in step 288. The actual equation to determine the variance between the unknown voice and each of the standard voices in the table is as follows:

Vx=ATTACK(CARRIER)/2+ATTACK(MODULATOR)/2+DECAY(CARRIER)/2+DECAY(MODULATOR)2+SUSTAIN(MODULATOR) *EGtype(MODULATOR)+MULTIPLE(MODULATOR)/2+TOTALLEVEL(MODULATOR) /2+FEEDBACK(MODULATOR)/2

In standard English, the equation would translate to half the absolute difference of the Attack(Carrier) of the unknown voice and the Attack(Carrier) of the standard voice PLUS half the absolute difference of the Attack(Modulator) of the unknown voice and the Attack(Modulator) of the standard voice PLUS half the absolute difference of the Decay(Carrier) of the unknown voice and the Decay(Carrier) of the standard voice PLUS half the absolute difference of the Decay(Modulator) of the unknown voice and the Decay(Modulator) of the standard voice PLUS the absolute difference of the Sustain(Modulator) of the unknown voice and the Sustain(Modulator) of the standard voice multiplied by the absolute difference of the EGtype(modulator) of the unknown voice and the EGtype(modulator) of the standard voice Plus half of the absolute difference of the Multiple(modulator) of the unknown voice and the Multiple(modulator) of the standard voice PLUS half of the absolute difference of the TotalLevel(Modulator) of the unknown voice and the TotalLevel(Modulator) of the standard voice PLUS half of the absolute difference of the Feedback(Modulator) of the unknown voice and the Feedback(modulator) of the standard voice.

FIG. 6H illustrates the set velocity procedure which begins in step 256 if the velocity has changed. In step 290, the total level of carrier parameter is retrieved from FM table which was written previously. The carrier value is inverted in step 291 and then doubled in step 292. The resulting value is returned in step 293.

Figure 6I:
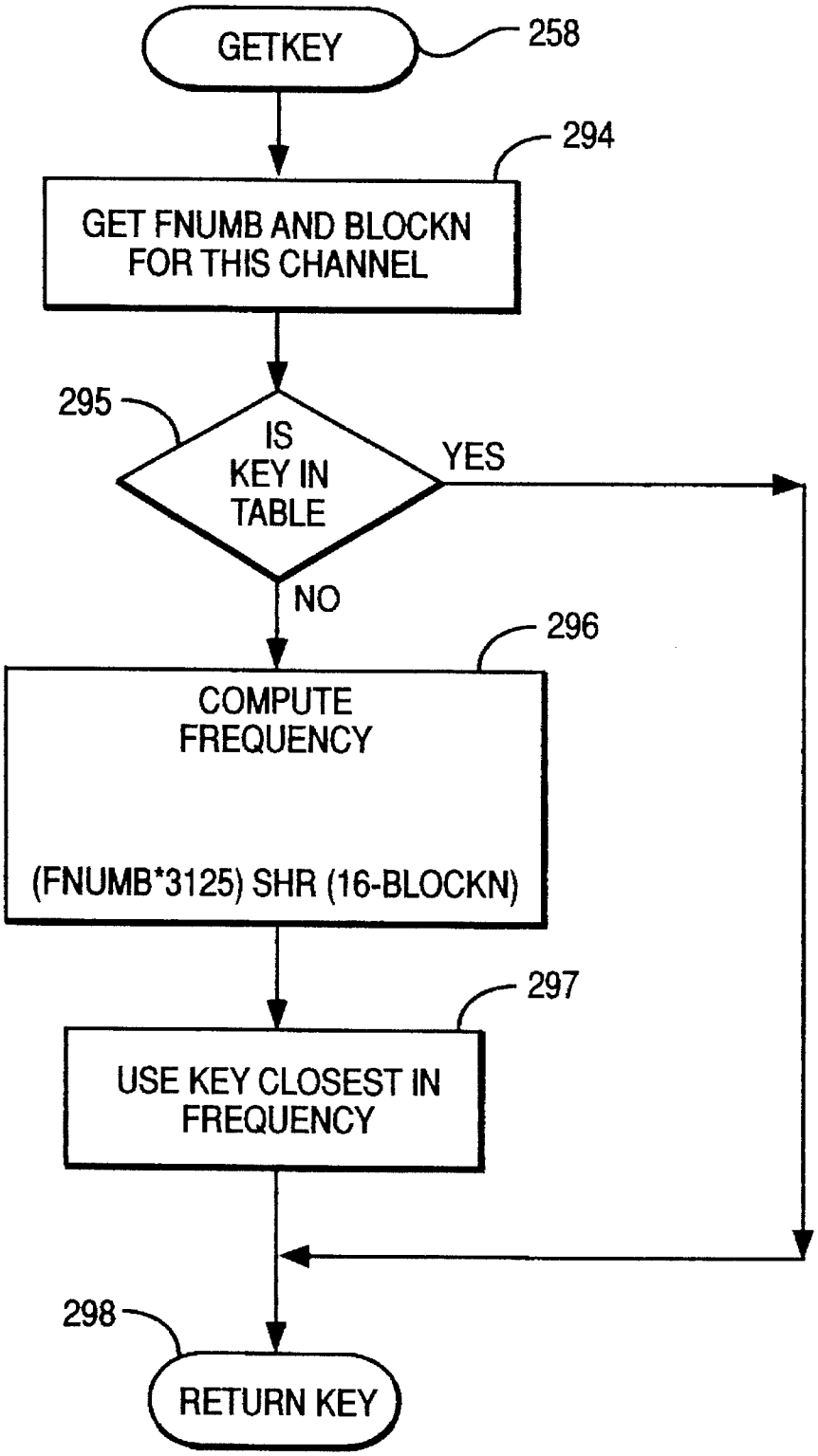

FIG. 6I depicts the get key procedure which begins in FIG. 6F in step 258. The key is the note or frequency that will be played by the hardware. Next, in step 294, the Fnumber and blockM values for this channel are retrieved. The Fnumber determines the frequency of the output signal and the blockM value determines the octave in the SoundBlaster™ hardware. Next, a test is performed in step 295 whether the key is in the table. If so, the key is returned in step 298. If not, the frequency is computed in step 296 using the equation (Fnum*3125) SHR (16-BLOCKN). Next, the key which is closest to the computed frequency is found in step 297 and that key returned in step 298.

Figure 7:
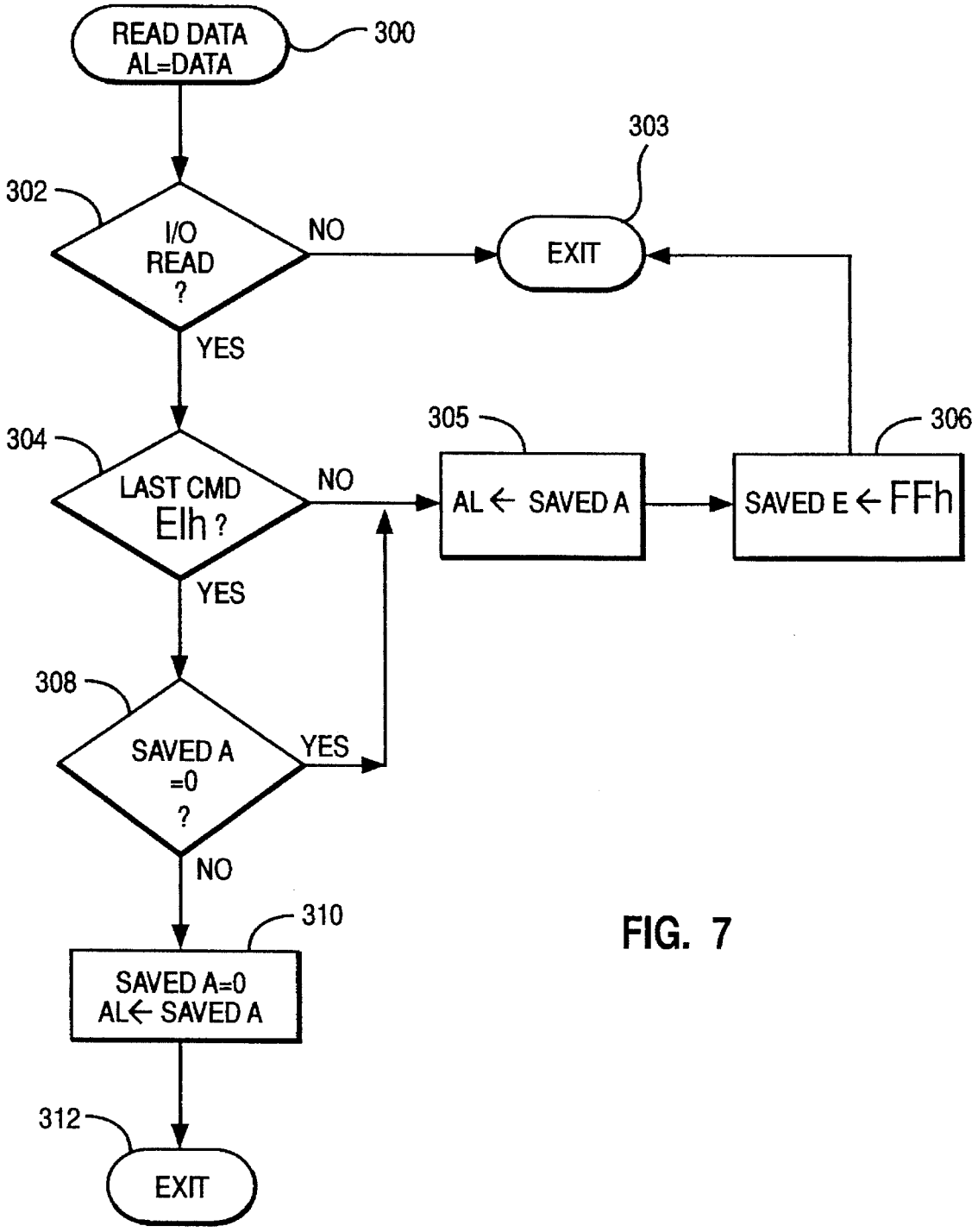
FIG. 7 is a flow diagram of a data read procedure.

FIG. 7 is a flow diagram for the read data process. First, in step 300 the initial I/O input from the application is read. In step 302, a test is performed to determine whether the I/O data indicates a read access. If not, the program exits, step 303. If it is an I/O read, a test is performed in step 304 to determine whether the last command written to the DSP was Elh. If not, the I/O data value AL step to the savedA in step 305. The savedE variable is set to FFh in step 306. If the last command to the DSP was Elh, the audio application expects two more bytes of information to follow. In step 308, a test is performed to determine whether savedA equals 0. If so, steps 305,306 are performed. If not, the savedA is set to 0 and the procedure returns with a previously saved value for the next read of the xxA port in step 310. The process ends in step 312.

Figure 8A:
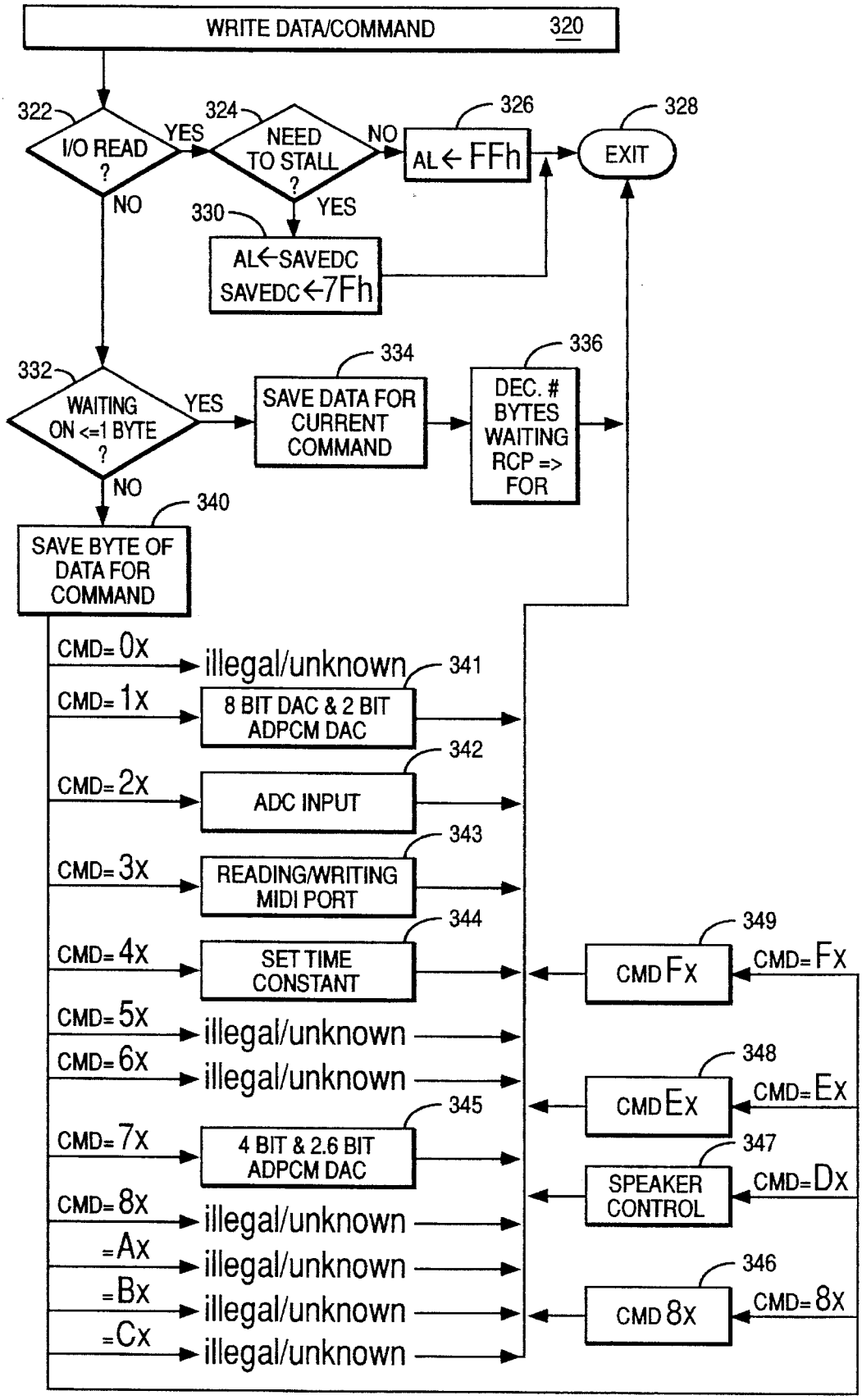
FIG. 8A–8I are flow diagrams of the data or command write procedure.

FIG. 8A depicts a flow diagram for the write data/command procedure for the present invention. In-step 320, an I/O command from the application is intercepted which indicates that a write data or write command operation to the card is sought by the audio application. In step 322, a test is performed to determined whether it is an I/O read command. If so, a second test is performed whether the interface or audio controller card need to wait in step 324. If not, the AL value is set to FFh, step 326, which indicates that the DSP is ready to receive the next command and the program exits 328. If the program interface needs to stall, AL is set to the latest value in savedC and the new value in savedC is set to 7Fh. This indicates that the DSP is not ready to receive any more commands at the present time. The process proceeds to exit, step 328.

If the I/O instruction is not an I/O read operation, a test is performed whether the interface is waiting for more than 1 byte of data for this command. step 332. If so, in step 334, the I/O data is saved for the current command. In step 336, the number of bytes the state machine is waiting for is determined. The process proceeds to the exit, step 328.

If the interface is waiting for more than 1 byte, the byte of I/O data is saved for the command in step 340. Once all the DATA bytes for the command have been received, the VDD continues down past step 340 to process the command which may be for either MIDI, PCM or ADPCM. For example, if the command is Ox, 5x, 6x, 9x, Ax, Bx, Cx the process will proceed to exit, step 328. If the command is equal to 2X, an 8 byte digital to analog converter (DAC) and a two-byte analog digital PMC DAC procedure, step 341, is performed. If the command equals 2x, an analog to digital converter input procedure step 342, is performed. If the command equals 3x, a read or write to a MIDI port in step 343 is performed. In step 344, the set time constant procedure is performed if the command is equal to 4x. A 4 bit and 2.6 bit ADPMC DAC is set in step 345 if the command is equal to 7X. If the command is equal to 8x, the command 8x procedure in step 346 is performed. The speaker control procedure in step 347 is performed if the command is equal to DX. The command EX or the command Fx procedures are performed if the command equals Ex or Fx in steps 348 and 349 respectively.

Figure 8B:
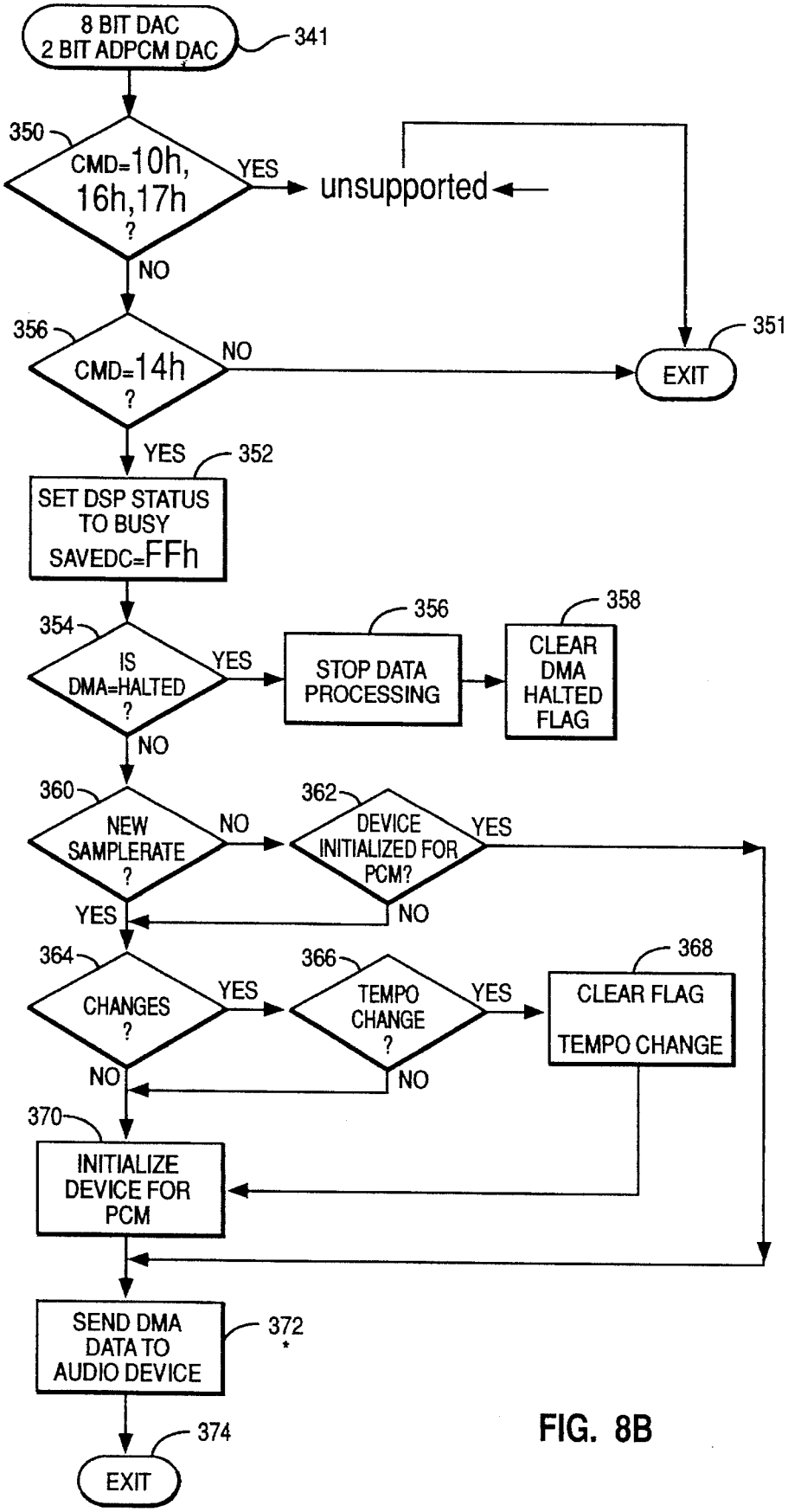

FIG. 8B depicts a flow diagram for the DMA write mode to a 8-bit DAC, one of the several DSP write commands supported by the SoundBlaster protocol. The other write commands are a direct write to an 8-bit DAC, a DMA write mode to a 2-bit Adaptive Delta Pulse Code Modulation (ADPCM) DAC, a second DMA write mode to a 2-bit ADPCM DAC with a reference byte and a direct write mode DAC. The ADPCM is a compression algorithm used by the DSP on the SoundBlaster. For sake of simplicity, only the first write mode associated with this command is depicted. Also, depending on the audio hardware, not all of these write modes can be supported unless they are provided by the VDD.

After the Ix command in step 341, a test is performed for the 14h I/O instruction which indicates that the DMA write mode for-the 8-bit DAC is called by the application. Next, in step 352, the DSP is set to busy and savedC is set to FFh. A test in step 354 determines whether the DMA write has halted. If so, in step 356, data processing is halted and in step 358 the DMA halted flag is cleared. If the DMA write is proceeding, step 360 tests for a new sample rate. If the sample rate stays stable, in step 362, a test is performed whether the audio card is initialized for PCM. If not, the process continues with step 364 which is a test for changes which need to be executed. If there are outstanding changes, a test for tempo changes is performed in step 366. If there are tempo changes, the flag for changing tempos is cleared in step 368. The process proceeds to step 370 where the audio hardware is initialized for the PCM operation. In step 372, the DMA data to be written to the device is sent. The process ends, step 374.

Figure 8C:
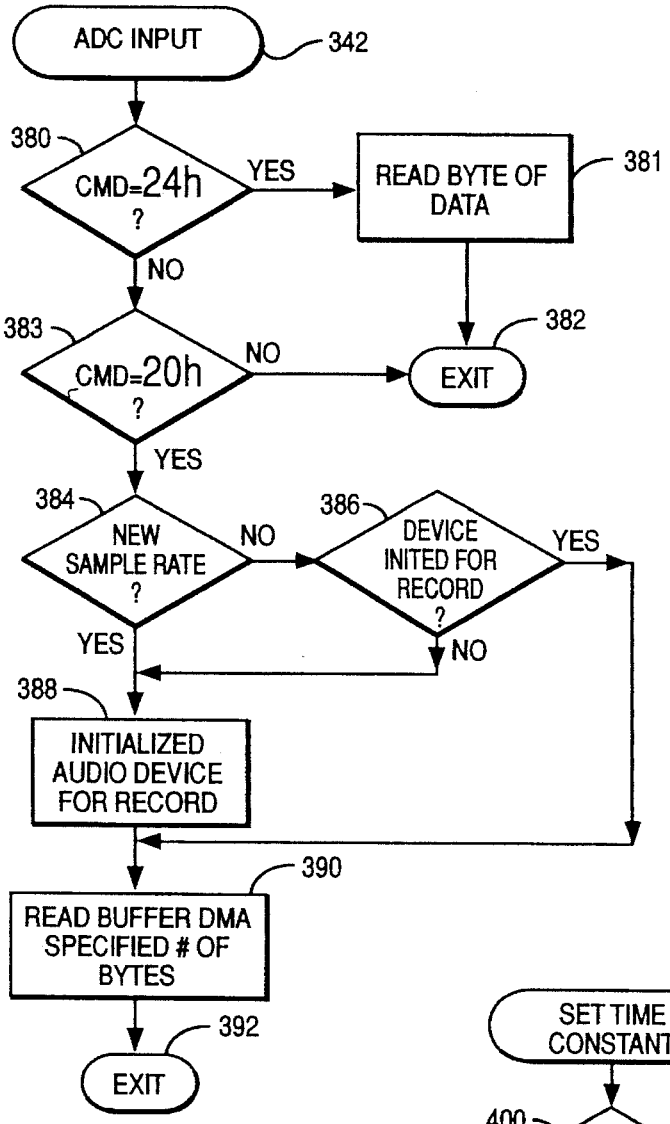

FIG. 8C depicts the process for Analog to Digital converter input to the audio card which might come from a microphone or other audio source. If 20h is the I/O instruction, the information is read directly from the audio card, step 380. If 24h is the I/O instruction, the information is read via a DMA mode, step 383. After the ADC input command, 2x, is received from the application, step 342, two tests are performed in steps 380 and 383 whether the expected types of ADC input modes have been specified. If the direct mode is specified, a command for the data to be read by the card in step 381 is sent. If neither command is detected, the procedure ends, step 382.

If the DMA mode is called, in step 384, a test for whether a new sample rate is requested is performed. If the same sample rate is requested, a test whether the audio card is properly initialized for recording is done in step 386. The process continues to step 388 if a new sample rate or proper initialization of the audio device is required. Next, in step 390, a buffer is read for the specified number of bytes in the DMA read operation. The process ends, step 392.

Figure 8D:
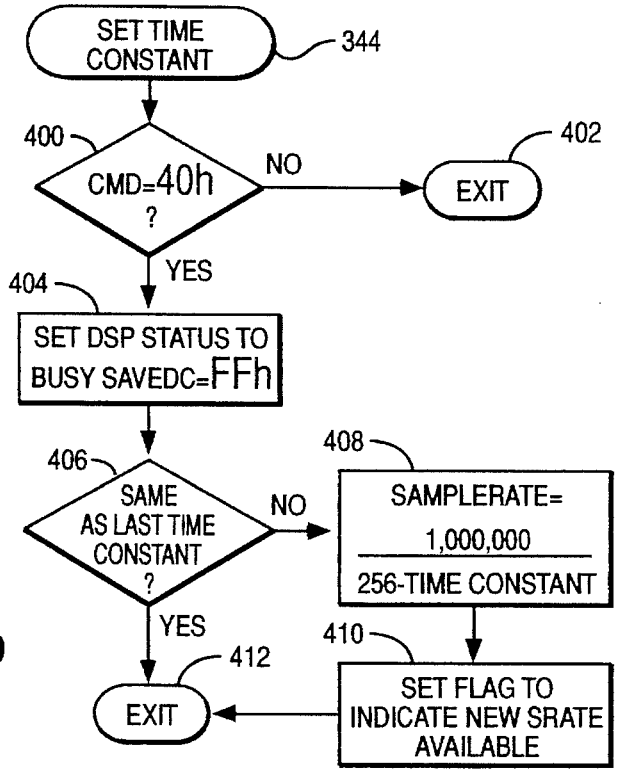

FIG. 8D depicts the set time constant procedure which is used to set the sampling rate for the DAC and ADC in DMA modes. The only I/0 instruction recognized is 40h. If the test in step 400, is negative, the process ends, step 402. If the application desires to change the sampling rate, in step 404, the DSP is set to busy and the savedC variable is set to FFh. Next, a test is performed in step 406 to determine whether the time constant is the same as last time, e.g., the sampling rate is constant. If not, the new sample rate is calculated using the formula:

Sample Rate =1,000,000//(256-time constant) in step 408.

The flag is set to indicate that a new sample rate is available in step 410. The process ends in step 412.

Figure 8E:
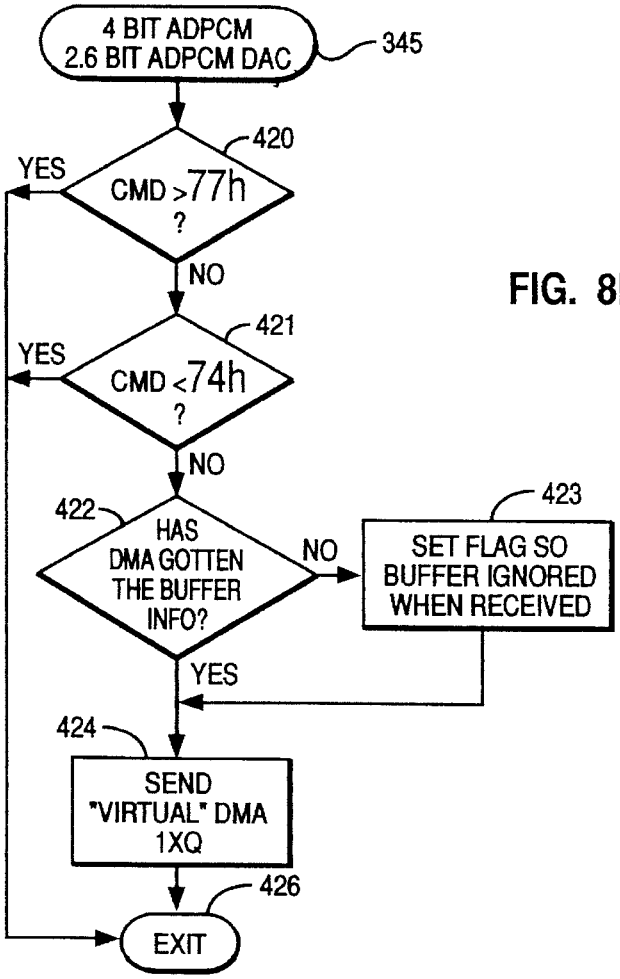

FIG. 8E is the flow diagram for the 4-bit ADPCM and 2.6 bit ADPCM DAC modes which are similar to those discussed in conjunction with FIG. 8B. If the I/O instruction does not fall between 74h and 77h, after the tests in step 420 or 421, the process will end. If the I/O instruction does fall within this range, the audio application intended to use one of several write modes supported by the SoundBlaster card. However, in this embodiment, none of the modes are supported by the audio hardware for which the VDD is built and the designer of the VDD did not choose to emulate support with the VDD. Therefore, the data which was sent by the application is simply thrown away. While this may not seem like a very good emulation, if the write mode is not supported by either hardware or software ignoring the request is less disruptive rather than halting the application. In step 422, a test is performed to determine whether the DMA data has been entered into the buffer. If not, a flag is set so the buffer is ignored when it is received. If so, a interrupt on the IRQ level that the application thinks it is audio devices is running on is sent to the application. The process ends in step 426.

Figure 8F:
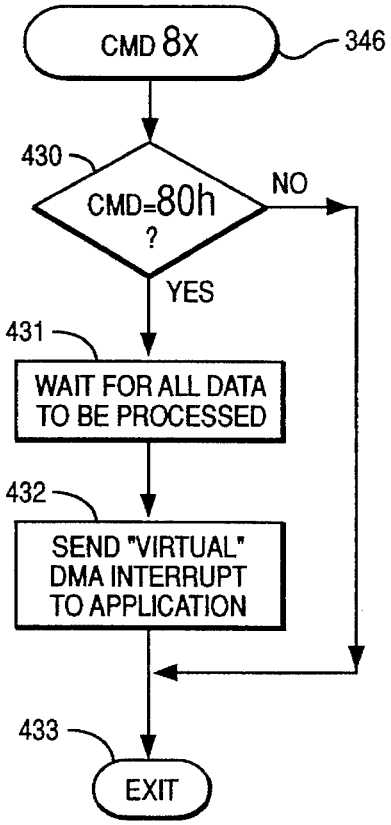

The "CMD 8x" write mode is depicted in FIG. 8F. It was found that emulating general undocumented operations was necessary to "fool" certain audio applications that they were interacting with the SoundBlaster™ Several of these modes appear to be testing modes, but it was also found that acceptable performance was possible by simply emulating the expected response, even if there was no actual knowledge of what the hardware was actually doing. Thus, reverse assembly or access to source code is not necessary. Although the CMD 8X mode is not documented, several audio applications use this mode to test the SoundBlaster™ card to determine which interrupts the card is using and whether these interrupts are working. If data is being played on the audio hardware associated with the VDD, this routine waits for the play to finish. At this point, the VDD returns an interrupt at the level which the application would expect to receive one. After the command 8x is received by the application in step 346, a test is performed to determine whether the I/O instruction is 80h in step 430. If not, the process ends. If so, the process continues to step 431 where the VDD waits until all the audio data has been processed by the card. Next in step 432, a "virtual" DMA interrupt is sent to the application. The process ends, step 433.

Figure 8G:
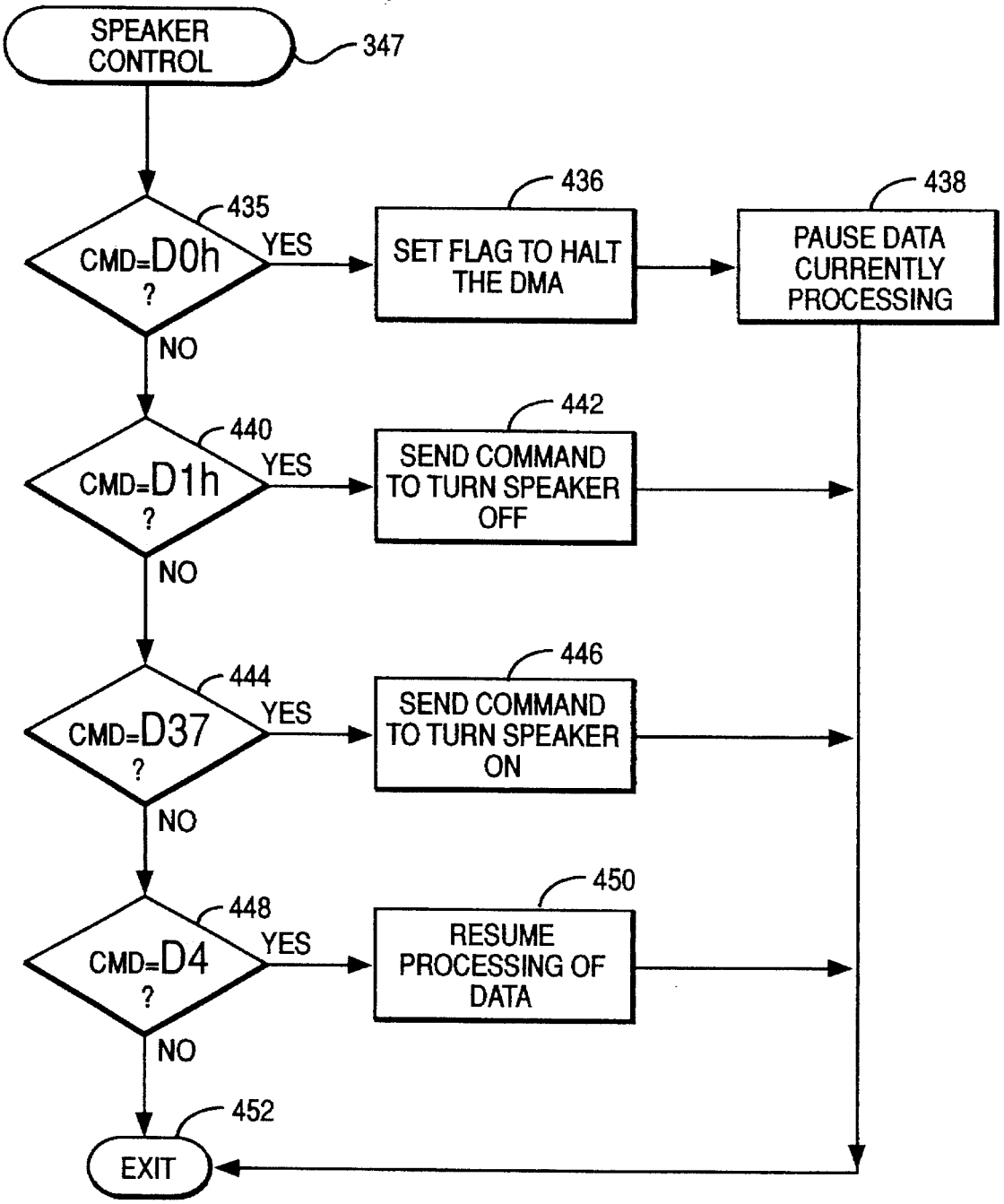

FIG. 8G shows the speaker control process. After the process is started in step 345, a test is performed for the DOh I/O instruction which indicates that the DMA operation be halted. If the DOh instruction is sent, step 436 sets the flag to halt the DMA operation and step 438 stops the data currently processing. If the Dlh I/O instruction is detected in step 440, it means that the speaker should be turned on. In step 442, the command to turn the speaker on is sent to the audio card. If the D3h command is detected in step 444, it means that the speaker should be turned off. Consequently, in step 446, the command to turn the speaker off is sent to the audio card. The presence of the D4h command is tested in step 448. If found, the halted DMA operation is resumed in step 450. The process ends in step 452.

Figure 8H:
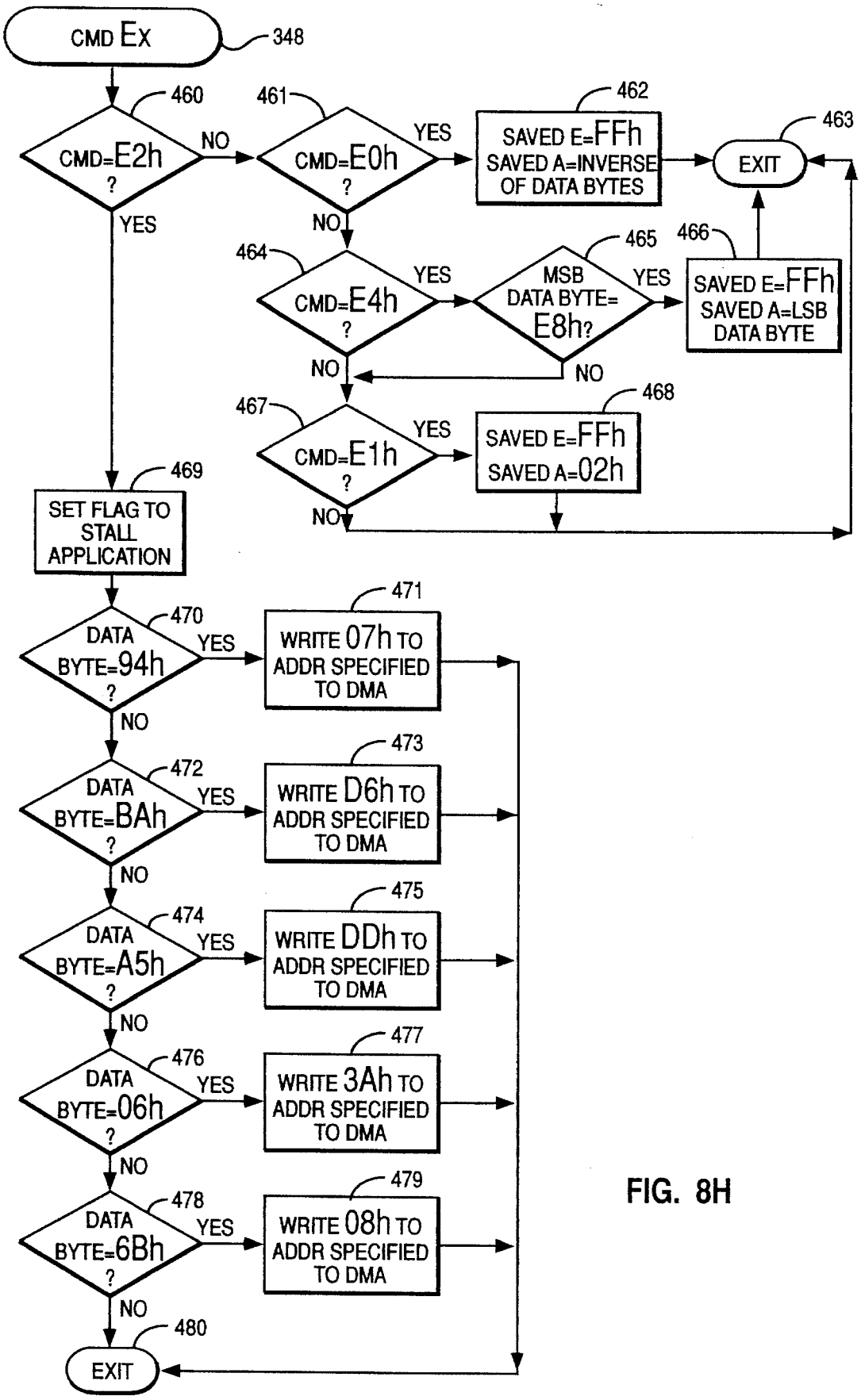

The CMD Ex operation is depicted in FIG. 8H. These are all commands done by the application to test to see if the audio card is functioning correctly or not. After initializing in step 348, a test for a E2h command from the audio application is conducted. This command checks for bit reversed. If the command is not detected, a test in step 461 for EOh is conducted. If successful, the savedE variable is set to FFh and the savedA variable is set to the inverse of the data byte. The process exits in step 463. If the test in step 461 fails, a test for an I/O instruction of E4h is performed. This test checks for bits not reversed, in step 464. If this test is successful, in step 465, a test for the most significant byte being set to E8h is conducted. If the step 465 test is successful, the savedE variable is set to FFh and the savedA variable is set to the least significant byte of data in step 466. If either of the tests in steps 464 and 465 are unsuccessful, a test for an Elh I/O instruction is performed in step 467. If Elh is found, the savedE variable is set to FFh and the savedA variable is set to 02h. The process ends in step 463.

If the I/O instruction was E2h, a flag is set in step 469 to stall the application. E2 command is followed by another byte of info for the command. This command checks the DMA operation. In step 470, if the data byte is 94h, O7h is written to the address specified for the DMA operation in step 471. In step 472, if the data byte is equal to BAh, D6h is written to the address specified by the DMA operation in step 473. Similarly, if the tests in steps 474, 476 or 478 successfully detect an I/O instruction of A5h, 06h or 6Bh respectively, DDh, 3At or O8h is written to the address specified by the DMA operation in steps 475, 477 or 479 respectively. The process ends, step 480.

Figure 8I:
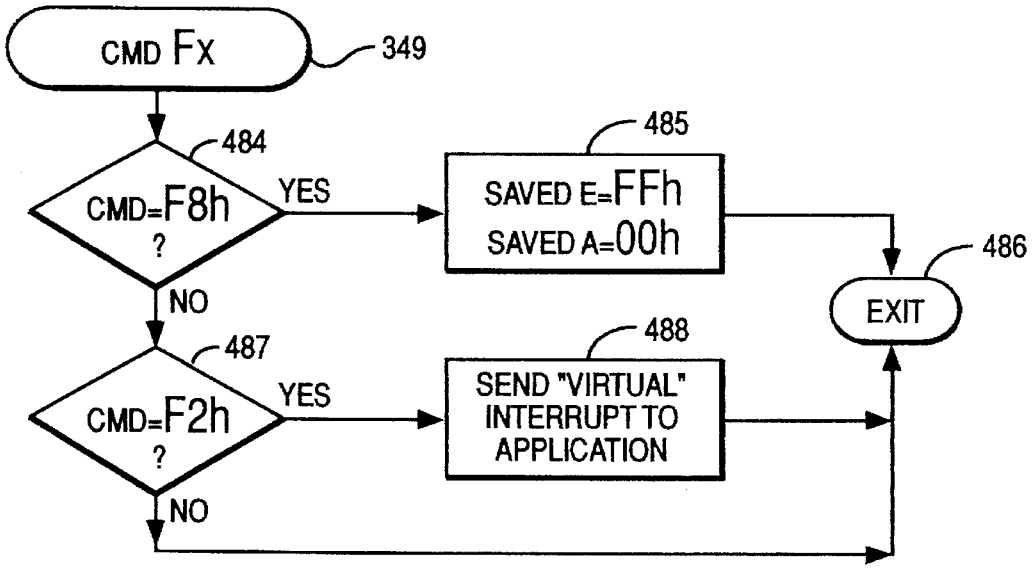

In FIG. 8I, the CMD Fx operation is depicted. This is another undocumented operation with which some applications interact with the SoundBlaster™. After starting in step 349, a test in step 484 is performed to determine whether the I/O instruction intercepted from the application is FSh. If so, the savedE variable is set to FFh meaning data is available to be read from DSP in the xxA port and the savedA variable is set to 00h. A second test is performed in step 487 to determine whether the I/O instruction from the audio application is F2h. If so, step 488 sends a interrupt to the application on the IRQ level that the emulated device would have been using. This is done by applications initially to determine what IRQ the hardware is setup to use. The process ends in step 486.

Figure 9:
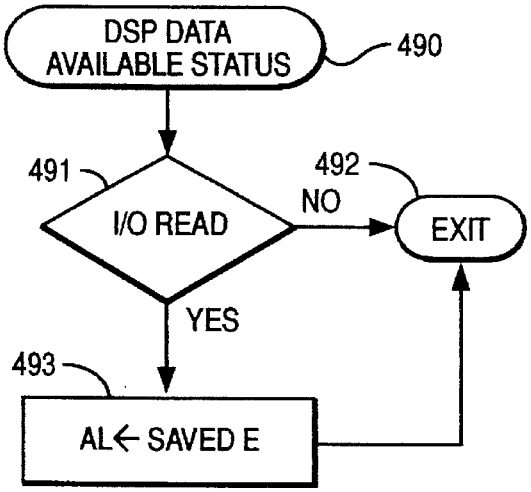
FIG. 9 is a flow diagram of a DSP data available status procedure.

FIG. 9 illustrates the DSP Data Available Status process which is used to tell the audio application that there is data available in the DSP for it to read. The process begins in step 490. A test is performed in step 491 whether the application has requested an I/O read process. If not, the process ends, step 492. If so, the output AL is set to the value stored in the savedE variable.

The following tables list the audio parameters used with the SoundBlaster™ set to the interface module and the MIDI voices which the interface module sends to the audio device driver or the audio hardware.

The parameters in TABLE 1 are used with the SoundBlaster Card to produce a sound:

TABLE 1

| | | ACOUSTIC GRAND | |
|---|---|---|---|
| parameter | Size_in_bits | PIANO | GUNSHOT |
| Amplitude Modulation (carrier) | 1 | 0 | 0 |
| Apply Vibrato (modulator) | 1 | 0 | 0 |
| Apply Vibrato (carrier) | 1 | 0 | 0 |
| Envelope Type (modulator) | 1 | 0 | 0 |
| Envelope Type (carrier) | 1 | 0 | 0 |
| Key Scaling Rate (modulator) | 1 | 0 | 0 |
| Key Scaling Rate (carrier) | 1 | 1 | 12 |
| Modulator Frequency Multiple (modulator) | 4 | 1 | 4 |
| Modulator Frequency Multiple (carrier) | 4 | 1 | 0 |
| Scaling Level (modulator) | 2 | 1 | 0 |
| Scaling Level (carrier) | 2 | 0 | 0 |
| Total level (modulator) | 6 | 15 | 0 |
| Total level (carrier) | 6 | 0 | 0 |
| Attach Rate (modulator) | 4 | 50 | 60 |
| Attach Rate (carrier) | 4 | 60 | 60 |
| Decay (modulator) | 4 | 4 | 0 |
| Decay (carrier) | 4 | 8 | 24 |

TABLE 1-continued

| parameter | Size_in_bits | ACOUSTIC GRAND PIANO | ACOUSTIC GRAND GUNSHOT |
|---|---|---|---|
| Sustain Level (modulator) | 4 | 20 | 60 |
| Sustain Level (carrier) | 4 | 16 | 56 |
| Release Rate (modulator) | 4 | 4 | 0 |
| Release Rate (carrier) | 4 | 12 | 24 |
| Wave Select (modulator) | 2 | 0 | 2 |
| Wave Select (carrier) | 2 | 0 | 0 |
| Feedback Factor | 3 | 3 | 7 |
| Connectivity type | 1 | 0 | 0 |

Table 2 presents

General MIDI voices which are selected using MIDI program change messages.

TABLE 2

General MIDI sound grouping (all channels ) except 10

| PROG # | INSTRUMENT GROUP |
|---|---|
| 1–8 | Piano |
| 9–16 | Chromatic Percussion |
| 17–24 | Organ |
| 25–32 | Guitar |
| 33–40 | Bass |
| 41–48 | Strings |
| 49–56 | Ensemble |
| 57–64 | Brass |
| 65–72 | Reed |
| 73–80 | Pipe |
| 81–88 | Synth Lead |
| 89–96 | Synth Pad |
| 97–104 | Synth Effects |
| 105–112 | Ethnic |
| 113–120 | Percussive |
| 121–128 | Sound Effects |

Table 3 lists 128 general MIDI instrument sounds.

TABLE 3

General MIDI Instrument Sounds Listing

| Prog # | Instrument name |
|---|---|
| 1. | Acoustic Grand Piano |
| 2. | Bright Acoustic Piano |
| 3. | Electric Grand Piano |
| 4. | Honky-tonk Piano |
| 5. | Electric Piano 1 |
| 6. | Electric Piano 2 |
| 7. | Harpsichord |
| 8. | Clavi |
| 9. | Celesta |
| 10. | Glockspspiel |
| 11. | Music Box |
| 12. | Vibraphone |
| 13. | Marimba |
| 14. | Xylophone |
| 15. | Tubular Bells |
| 16. | Dulcimer |
| 17. | Drawbar Organ |
| 18. | Percussive Organ |
| 19. | Rock Organ |
| 28. | Electric Guitar (clean) |
| 29. | Electric Guitar (muted) |
| 30. | Overdrive Guitar |
| 31. | Distortion Guitar |
| 32. | Guitar harmonics |

TABLE 3-continued

General MIDI Instrument Sounds Listing

| Prog # | Instrument name |
|---|---|
| 33. | Acoustic Bass |
| 34. | Elec. Bass (finger) |
| 35. | Elec. Bass (pick) |
| 36. | Fretless Bass |
| 37. | Slap Bass 1 |
| 38. | Slap Bass 2 |
| 39. | Synth Bass 1 |
| 40. | Synth Bass 2 |
| 41. | Violin |
| 42. | Viola |
| 43. | Cello |
| 44. | Contrabass |
| 45. | Tremolo Strings |
| 46. | Pizzicato Strings |
| 47. | Orchestral harp |
| 48. | Timpani |
| 49. | String Ensemble 1 |
| 50. | String Ensemble 2 |
| 51. | SynthStrings 1 |
| 60. | Muted Trumpet |
| 61. | French Horn |
| 62. | Brass Section |
| 63. | SynthBrass 1 |
| 64. | SynthBrass 2 |
| 65. | Soprano Sax |
| 66. | Alto Sax |
| 67. | Tenor Sax |
| 68. | Baritone Sax |
| 69. | Oboe |
| 70. | English Horn |
| 71. | Bassoon |
| 72. | Clarinet |
| 73. | Piccolo |
| 74. | Flute |
| 75. | Recorder |
| 76. | Pan Flute |
| 77. | Blown Bottle |
| 78. | Shakuhachi |
| 79. | Whistle |
| 80. | Ocarina |
| 81. | Lead 1 (square) |
| 82. | Lead 2 (sawtooth) |
| 83. | Lead 3 (calliope) |
| 92. | Pad 4 (choir) |
| 93. | Pad 5 (bowed) |
| 94. | Pad 6 (Metallic) |
| 95. | Pad 7 (halo) |
| 96. | Pad 8 (sweep) |
| 97. | FX 1 (rain) |
| 98. | FX 2 (soundtrack) |
| 99. | FX 3 (crystal) |
| 100. | FX 4 (atmosphere) |
| 101. | FX 5 (brightness) |
| 102. | FX 6 (goblins) |
| 103. | FX 7 (echoes) |
| 104. | FX 8 (Sci-fi) |
| 105. | Sitar |
| 106. | Banjo |
| 107. | Shamisen |
| 108. | Koto |
| 109. | Kalimba |
| 110. | Bag pipe |
| 111. | Fiddle |
| 112. | Shanai |
| 113. | Tinkle Bell |
| 114. | Agogo |
| 115. | Steel Drums |
| 124. | Bird T'weet |
| 125. | Telephone Ring |
| 126. | Helicopter |
| 127. | Applause |
| 128. | Gunshot |

Figure 10:
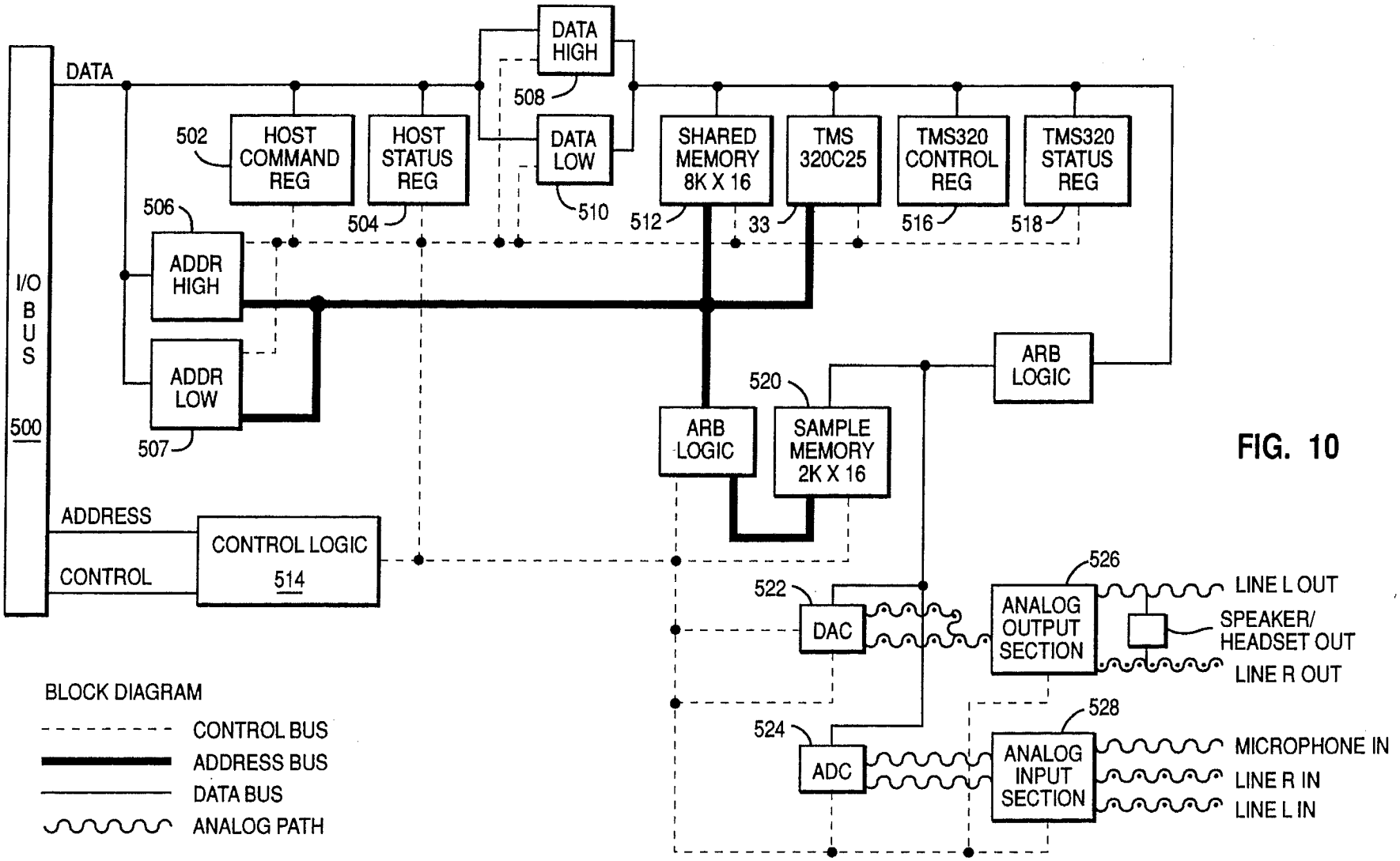
FIG. 10 depicts an audio controller card which can be used with the present invention.

FIG. 10 depicts the audio controller card which includes a digital signal processor (DSP) 33 for the correction of the speaker response. One possible audio controller is the M-Audio Capture and Playback Adapter announced and shipped on Sep. 18, 1990 by the IBM Corporation. Referring to FIG. 10, the I/O bus is a microchannel or PC I/O bus 500 which allows the Personal computer to pass information via the I/O bus 500 to the audio controller. A command register 502, a status register 504 and address high byte counter 506 and address low byte counter 507, a high data high byte bidirectional latch 508, and a data low bidirectional latch 510 are also included on the audio controller card. The registers are used by the personal computer to issue commands and monitor the status of the audio controller card. The address and data latches are used by the personal computer to access the shared memory 512, which is an 8K by 16 bit static RAM on the audio controller card. The shared memory 512 also provides a means of communication between the personal computer and the digital signal processor 33.

A memory arbiter, part of the control logic 514, prevents the personal computer and the DSP 33 from accessing the shared memory 512 at the same time. The shared memory 512 can be divided so that part of the stored information is logic used to control the digital signal processor 33. The digital signal processor has its own control registers 416 and status registers 518 for issuing commands and monitoring the status of other parts of the audio controller card.

The audio controller card contains another block of RAM called the sample memory 520. The sample memory 520 is a 2K by 16 bit static RAM which the DSP 33 uses to store outgoing audio signals to be played on the speaker systems or store incoming signals of digitized audio. The digital analog converter (DAC) 522 and the analog digital converter (ADC) 524, convert the audio signal between the digital environment of the computer and the analog sound produced or received by the speakers. The DAC 522 receives digital samples from the sample memory 520, converts the samples to analog signals and sends these signals to the analog output section 526. The analog output section 526 conditions and sends the digital signals provided by the personal computer to the output connectors for transmission via the speaker system. As the DAC 522 is multiplexed, continuous stereo operation can be given to both right and left speaker components.

The ADC 524 is the counterpart of the DAC 522. The ADC 524 receives analog signals from the analog input section 528 which receives the signals from a microphone or another audio input device such as a tape player. The ADC 524 converts the analog signals to digital, samples and stores them in the sample memory 520. The control logic 514 issues interrupts to the personal computer after the DSP 33 has issued an interrupt request. Arbitration logic, shown here as two blocks 530 and 532, prevents the DSP from accessing the Sample Memory 520 at the same time as the DAC 522 or ADC 524. This is a standard practice within the industry.

Providing a stereo audio signal to the speaker system works in the following way. The personal computer informs the DSP 33 that the audio card should play a particular sample of digitized sound data. In the subject invention, the personal computer gets the digital audio samples from its memory or disk storage and transfers them to the shared memory 512 through the I/O bus 500. The DSP 33 takes the samples and converts them to scaled values and places them in the sample memory 520. The DSP 33 then activates the DAC 522 which converts the digitized samples into audio signals, the audio output section 526 conditions the audio signals and places them on the output connectors.

The DSP code implements an 8 channel sound generator. A data area associated with each sound generator is written to by the Audio Device Driver just prior to sounding a note. The Audio Device Driver maintains a table of 175 sets of these data, one per sound or program change.

Upon receipt of a MIDI program change, the Audio Device Driver simply saves away the new program change number for use when subsequent Note-Ohs occur on that MIDI channel. Upon receipt of a Note-On event, the Audio Device Driver recalls the program change number for the Note-On's MIDI channel number. It then selects an unused DSP sound generator. If none are available it forces the oldest sounding note to the off state. It then copies the voicing information for the program number into the selected sound generator, and sets a bit telling the sound generator to begin making sound.

Any MIDI Control Changes received result in the associated data, for example, pitch for pitch bend, volume for volume change, etc., being updated or modified for each currently sounding note assigned to the MIDI channel specified in the Control Change. Control Changes can occur prior to a Note-On event and will still be reflected in the note. The invention has been described with reference to particular embodiments above, it would be understood by those skilled in the art that modifications may be made without departing from the spirit and scope of the present invention. These embodiments are purposes of example and illustration only and are not to be taken to limit the scope of the invention narrower than the scope of the appended claims.

We claim:

1. A method for using I/O instructions from an audio application resident in a memory of a computer system intended for registers of a first type of audio card to interact with a second type of audio card, comprising the steps of:

intercepting a first I/O instruction from the audio application;

determining by table lookup an audio voice which corresponds to data in the first I/O instruction; and transmitting audio data corresponding to the audio voice to the second type of audio card coupled to the computer system and a second I/O instruction to the audio application expected in response to the first I/O instruction.

2. The method as recited in claim 1 which further comprises the steps of:

responsive to an absence of a corresponding audio voice, calculating a weighted average of the data in the first I/O instruction and selecting an audio voice as a closest match having a value closest to the weighted average; and, transmitting audio data corresponding to the audio voice which is the closest match to the second type of audio card coupled to the computer system and an expected I/O instruction to the audio application.

3. The method as recited in claim 2 which further comprises the steps of:

determining whether a value of a first audio parameter corresponding to each audio voice matches a value of the first audio parameter in the first I/O instruction where there is a single value for the first audio parameter for each audio voice; and, discarding any audio voice as a contender for the closest match whose first audio parameter value does not match the first audio parameter value of the first I/O instruction where there is a single value for the first audio parameter for each audio voice.

4. The method as recited in claim 2 wherein the data in the first I/O instruction is a plurality of values for a set of parameters and each audio voice corresponds to a plurality of values for the set of parameters, and the method further comprises the steps of:

determining a difference between a first audio parameter in the first I/O instruction and the value for the first audio parameter corresponding to the audio voice which is the closest match; and, altering the audio data according to the difference.

5. The method as recited in claim 2 wherein the data in the first I/0 instruction is a plurality of values for a set of parameters and each audio voice corresponds to a plurality of values for the set of parameters and the method further comprises the step of:

if a weighted average of the values of the set of parameters for the closest match exceeds a predetermined difference from the weighted average of the first I/O instruction, selecting the audio voice whose value for a first audio parameter matches the value of the first parameter in the first I/O instruction.

6. The method as recited in claim 1 which further comprises the steps of:

determining which register of the first type of audio card the I/O instruction was intended; and sending the I/O instruction to a transformation module which corresponds to the register.

7. The method as recited in claim 1 which further comprises the steps of:

finding a requested sample rate in the first I/O instruction; and in the absence of the requested sample rate in the second type of audio card, sending the closest available rate in the audio data.

8. The method as recited in claim 1 which further comprises the steps of:

maintaining the audio application in a virtual machine in an operating system; and, wherein intercepting the I/O instruction from the audio application is accomplished with a virtual device driver.

9. The method as recited in claim 1 wherein the data in the first I/O instruction comprise a plurality of FM synthesis parameters.

10. The method as recited in claim 1 wherein I/O instructions from a second audio application resident in the memory of the computer system intended for a third type of audio card are used to interact with the second type of audio card concurrently with I/O instructions from the first audio application.

11. A system for using I/O instructions from an audio application to a second format intended for registers of a first type of audio card to interact with a second type of audio card, comprising:

a memory for storing sets of instructions for performing computer functions, the sets of instructions including the audio application and a translating program;

a processor coupled to the memory for carrying out the sets of instructions;

an audio card coupled to the processor for performing audio functions according to an I/O instruction from the audio application;

the translating program comprising:

means for intercepting a first I/O instruction written in the first format including a first plurality of audio parameters from the audio application;

means for determining an audio voice which corresponds to data in the first I/O instruction;

means for transmitting audio data corresponding to the audio voice to the second type of audio card coupled to the computer system and a second I/O instruction to the audio application expected in response to the first I/O instruction the means being activated when the translating program is resident in memory and activated by the processor.

12. The system as recited in claim 11 further comprising:

means responsive to an absence of a corresponding audio voice for calculating a weighted average of the data in the first I/O instruction and selecting an audio voice as a closest match having a value closest to the weighted average; and, means for transmitting audio data corresponding to the audio voice which is the closest match to the second type of audio card coupled to the computer system and an expected I/O instruction to the audio application.

13. The system as recited in claim 12 further comprising:

means for determining whether a value of a first audio parameter in each selected set corresponding to each audio voice matches a value of the first audio parameter in the first I/O instruction where there is a single value for the first audio parameter for each audio voice; and, means for discarding any audio voice as a contender for the closest match whose first audio parameter value does not match the first audio parameter value of the first plurality of audio parameters I/O instruction.

14. The system as recited in claim 12 wherein the data in the first I/O instruction is a plurality of values for a set of parameters and each audio voice corresponds to a plurality of values for the set of parameters, and the method wherein the translating program further comprises:

means for determining a difference between a first audio parameter in the first plurality I/O instruction and the value for the first audio parameter in the closest set corresponding to the audio voice which is the closest match; and, means for altering the audio data according to the difference.

15. The system as recited in claim 12 wherein the data in the first I/O instruction is a plurality of values for a set of parameters and each audio voice corresponds to a plurality of values for the set of parameters and the method wherein the translating program further comprises:

means responsive to a weighted average of the values of the set of parameters exceeding a predetermined difference from the weighted average of the first I/O instruction for the closest match for selecting the audio voice whose value for a first audio parameter matches the value of the first parameter in the first plurality.

16. The system as recited in claim 11 which further comprises:

a virtual machine in an operating system in which to maintain the audio application; and, the translating program is a virtual device drive.

17. The system as recited in claim 11 wherein the audio parameters are data in the first I/O instruction comprise a plurality of FM synthesis parameters and the audio voices are a set of generalized MIDI voices.

18. A system for using I/O instructions from an audio application intended for registers of a first type of audio card to interact with a second type of audio card, for use in a data processing system having a memory and a processor comprising:

an audio card of the second type for performing audio functions according to an I/O instruction from the audio application;

a translating program on a storage device comprising;

means for intercepting a first I/O instruction from the audio application;

means for determining an audio voice which corresponds to data in the first I/O instruction; and, means for transmitting audio data corresponding to the audio voice to the second type of audio card coupled to the computer system and a second I/O instruction to the audio application expected in response to the first I/O instruction, the means being activated when the storage device is connected to and accessed by the data processing system.

19. A storage device for using I/O instructions from an audio application intended for registers of a first type of audio card to interact with a second type of audio card, for use in a data processing system having a memory and a processor comprising:

means for intercepting a first I/O instruction from the audio application;

means for determining by table lookup an audio voice which corresponds to data in the first I/O instruction; and, means for transmitting audio data corresponding to the audio voice to the second type of audio card, coupled to the computer system and a second I/O instruction to the audio application expected in response to the first I/O instruction, the means being activated when the storage device is connected to and accessed by the data processing system.

20. The device as recited in claim 19 which further comprises:

means responsive to an absence of a corresponding audio voice of calculating a first output value of a function using the data in the first I/O instruction as inputs and selecting an audio voice as a closest match having a value closest to the first output value; and, means for transmitting audio data corresponding to the audio voice which is the closest match to the second type of audio card coupled to the computer system and an expected I/O instruction to the audio application.

21. The device as recited in claim 20 which further comprises:

means for determining whether a value of a first audio parameter corresponding to each audio voice matches a value of the first audio parameter in the first I/O instruction where there is a single value for the first audio parameter for each audio voice; and, means for discarding any audio voice as a contender for the closest match whose first audio parameter value does not match the first audio parameter value of the first I/O instruction.

22. The device as recited in claim 20 wherein the data in the first I/O instruction is a plurality of values for a set of parameters and each audio voice corresponds to a plurality of values for the set of parameters, and the method further comprises:

means for determining a difference between the value for a first audio parameter in the first I/O instruction and the value for the first audio parameter corresponding to the audio voice which is the closest match; and, means for altering the audio data according to the difference.

23. The device as recited in claim 20 wherein the data in the first I/O instruction is a plurality of values for a set of parameters and each audio voice corresponds to a plurality of values for the set of parameters and the method further comprises:

means responsive to the determination that a weighted average of the values of the set of parameters exceeds a predetermined difference from the first I/O instruction for the closest match for selecting the audio voice whose value for a first audio parameter matches the value of the first parameter in the first I/O instruction.

24. The device as recited in claim 19 wherein the data in the first I/O instruction comprise a plurality of FM synthesis parameters and the audio voices are a set of generalized MIDI voices.

* * * * *

UNITED STATES PATENT AND TRADEMARK OFFICE

CERTIFICATE OF CORRECTION

PATENT NO. : 5,515,474

DATED : May 7, 1996

INVENTOR(S) : John Deacon, Ron Lisle and Bridget Ritthaler

It is certified that error appears in the above-indentified patent and that said Letters Patent is hereby corrected as shown below:

Col. 2, line 41, delete "(DSP" insert --(DSP)--;
line 46, delete "FIG." insert -- FIGS--.
line 51, delete "," insert --.--;
line 57, delete ",", first occurrence, insert --.--;
Col. 5, line 59, delete "registers." insert --register.--;
Cols. 9 and 10, line 2 of the equation in the middle of the page, delete "CAY(MODULATOR)2" insert --CAY(MODULATOR)/2--;
Col. 12, line 6, delete "Ix" insert --1x--;
line 54, in the equation, delete "//" insert --/--;
Col. 18, line 8, delete "Note-Ohs" insert --Note-Ons--;
Col. 20, line 58, delete "drive." insert --driver.--; and
Col. 21, line 37, delete "voice of" insert --voice for--.

Signed and Sealed this

Twentieth Day of August, 1996

Bruce Lehman

*Attest:*

BRUCE LEHMAN

*Attesting Officer*

*Commissioner of Patents and Trademarks*